US010869144B2

(12) United States Patent
Darlington et al.

(10) Patent No.: US 10,869,144 B2
(45) Date of Patent: Dec. 15, 2020

(54) METHOD AND APPARATUS FOR TESTING EARPHONE APPARATUS

(71) Applicant: SOUNDCHIP SA, Aran-Villette (CH)

(72) Inventors: Paul Darlington, Aran-Villette (CH); Ben Skelton, Aran-Villette (CH)

(73) Assignee: SOUNDCHIP SA, Aran-Villette (CH)

( * ) Notice: Subject to any disclaimer, the term of this patent is extended or adjusted under 35 U.S.C. 154(b) by 0 days.

(21) Appl. No.: 16/072,732

(22) PCT Filed: Jan. 20, 2017

(86) PCT No.: PCT/GB2017/050142
§ 371 (c)(1),
(2) Date: Jul. 25, 2018

(87) PCT Pub. No.: WO2017/129951
PCT Pub. Date: Aug. 3, 2017

(65) Prior Publication Data

US 2019/0037324 A1 Jan. 31, 2019

(30) Foreign Application Priority Data

Jan. 26, 2016 (GB) ..... 1601453.2

(51) Int. Cl.
*H04R 29/00* (2006.01)
*H04R 1/08* (2006.01)
*H04R 1/10* (2006.01)

(52) U.S. Cl.
CPC ..... *H04R 29/001* (2013.01); *H04R 1/08* (2013.01); *H04R 1/105* (2013.01); *H04R 1/1008* (2013.01); *H04R 29/00* (2013.01)

(58) Field of Classification Search
CPC ..... H04R 29/001; H04R 1/08; H04R 1/1008; H04R 1/105; H04R 29/00
(Continued)

(56) References Cited

U.S. PATENT DOCUMENTS 4,741,035 A * 4/1988 Genuit ..... H04R 5/027 381/26
5,928,160 A 7/1999 Clark
(Continued)

FOREIGN PATENT DOCUMENTS

EP 2728906 5/2014
GB 1430485 3/1976
(Continued)

OTHER PUBLICATIONS

GRAS, "Instruction Manual GRAS 45BB KEMAR Head and Torso—GRAS 45BC KEMAR Head and Torso with Mount Simulator", Aug. 13, 2015; REV 6 (Year: 2015).*
(Continued)

*Primary Examiner* — David L Ton
(74) *Attorney, Agent, or Firm* — Lempia Summerfield Katz LLC

(57) ABSTRACT

Apparatus for testing earphone apparatus (10) during manufacture includes a head simulator (30) including an ear simulator (40) defining a passageway (42) leading to an external opening (44), a and an eardrum microphone (46) mounted in the passageway (42) of the ear simulator (40). The apparatus (10) includes one or more of: an ear plate (50) for simulating an outer ear, the ear plate (50) forming part of the ear simulator (40) and defining a substantially planar earphone engagement surface (52) substantially encircling the external opening (44); a mounting guide system for assisting correct placement of earphone apparatus on the head simulator (30) relative to the ear simulator (40); and a test module (100) for performing rapid automated testing of earphone apparatus mounted on the head simulator (30).

64 Claims, 8 Drawing Sheets

(58) Field of Classification Search
USPC ..... 381/56
See application file for complete search history.

(56) References Cited

U.S. PATENT DOCUMENTS

| | | | |
|---|---|---|---|
| 8,977,376 | B1 | 3/2015 | Lin |
| 2006/0093159 | A1 | 5/2006 | Koh et al. |
| 2012/0288079 | A1 | 11/2012 | Burnett et al. |

FOREIGN PATENT DOCUMENTS

| | | | |
|---|---|---|---|
| WO | 2012120295 | | 9/2012 |
| WO | WO2015128390 | A1 | 9/2015 |

OTHER PUBLICATIONS

International Search Report and Written Opinion in International Application No. PCT/GB2017/050142, dated Jun. 29, 2017, 20 pages.
Partial European Search Report in EP Application No. 19 21 0842, dated Mar. 12, 2020, 11 pages.

* cited by examiner

METHOD AND APPARATUS FOR TESTING EARPHONE APPARATUS

RELATED APPLICATION DATA

This U.S. national phase application is based on International Application No. PCT/GB2017/050142, filed on Jan. 20, 2017, which claimed priority to British Patent Application No. 1601453.2, filed on Jan. 26, 2016. Priority benefit of these earlier filed applications is hereby claimed.

The present invention relates to a method and apparatus for testing earphone apparatus and particularly, but not exclusively to a method and apparatus for testing earphone apparatus with Active Noise Reduction (ANR) functionality.

Earphones (e.g. circumaural or supra-aural earphones of the type connected together by a headband to form headphones or in-ear/in-the-canal earphones configured to be placed at the entrance to or in the auditory canal of a user's ear) are well known in the art. Active earphone systems incorporating an active earphone driver for providing advanced active features such as Active Noise Reduction (ANR) or binaural monitoring are also well known in the art. ANR techniques offer the capability to cancel (at least some useful portion of) unwanted external sound and/or unwanted sound sensed by an internal sensing microphone via feedback control.

Earphones are typically tested in laboratory conditions on Head and Torso Simulators ('HATS') devices which simulate the acoustic behaviour of the upper part of the human body and the ear. These HATS devices provide a useful development environment for the devices, specifically including elaborate and accurate acoustic representations of the outer ear, through the provision of "artificial ears" or "ear simulators", constructed to international standards. Both the HATS device and their integral artificial ears are high-value items, appropriate for use in the development laboratory, but unsuited for mass deployment in production lines for device configuration, testing and quality control.

Further, some aspects of the conventional HATS devices (specifically, their geometry around the pinna simulator and the presence of any grooves or joints between different surfaces near to the pinna) have been found to prejudice the repeatability of response of a circum-aural headphone upon repeat placement. Similarly, the presence of any kind of pinna simulator—whilst clearly representative of the anthropological prototype—does not encourage repeatable response of a supra-aural headphone upon repeat placement.

The present applicant has identified the opportunity for an improved form of testing apparatus that overcomes or at least alleviates limitations of the prior art and permits testing of earphone apparatus in a factory environment as part of the manufacturing process.

In accordance with a first aspect of the present invention, there is provided apparatus for testing earphone apparatus during manufacture, comprising: a head simulator including an ear simulator defining a passageway leading to an external opening; and an eardrum microphone mounted in the passageway of the ear simulator part; wherein the apparatus comprises one or more of: an ear plate for simulating an outer ear, the ear plate forming part of the ear simulator and defining a substantially planar earphone engagement surface substantially encircling the external opening; a mounting guide system for assisting correct placement of earphone apparatus on the head simulator relative to the ear simulator; and a test module for performing (e.g. rapid) automated testing of earphone apparatus mounted on the head simulator.

In this way, apparatus is provided that is operative to allow quick and predictable testing of earphone apparatus in a production line manufacturing process. The passageway and ear plate are configured to approximate the auditory canal and outer ear respectively of a user. However, the novel earphone engagement surface of the ear plate is designed for ease and predictability of earphone placement rather than anatomical accuracy.

The apparatus of the present invention is principally intended for use in testing earphones apparatus comprising ANR functionality. The earphone apparatus may include at least one feedforward microphone positioned to sense external ambient acoustic noise and may include at least one feedback microphone (e.g. for sensing pressure changes in a volume (e.g. sealed volume) between a driver of the earphone and the auditory canal of the user's ear). In one embodiment, the earphone apparatus may comprise (e.g. further comprise) at least one feedforward microphone (e.g. for sensing sound external to the earphone device e.g. for feedforward noise reduction or binaural monitoring/talk through function). In one embodiment, the earphone apparatus may be programmable (e.g. include at least one programmable filter).

The earphone apparatus may take the form of headphones (e.g. a pair of earphone units (typically circumaural or supra-aural earphone units) connected together by a headband) or headbandless in-ear/in-the-canal earphone units configured to be placed at the entrance to or in the auditory canal of a user's ear and held in place by engagement with the user's ears.

Typically the head simulator will be in the form of a head and torso simulator (HATS) device. In one embodiment, the HATS device comprises a torso portion housing the test module.

In one embodiment, the ear plate comprises a part that is detachable from the head simulator (e.g. to allow alternative ear simulator parts to be attached). For example, the ear plate may comprise a base portion connected (e.g. fixed) to the head simulator and a detachable outer part defining the substantially planar earphone engagement surface. In this way, the ear plate may be quickly and easily modified for testing of different earphone apparatus. In one embodiment, the detachable outer part is connected to the base portion by a quick-release coupling.

In one embodiment, wherein the mounting guide system comprises a headband positioning guide (e.g. guide channel) operative to assist positioning of a headband in a predetermined orientation relative to the head simulator.

In one embodiment, the mounting guide system comprises an earphone unit positioning guide. In this way, each individual earphone unit (e.g. shell in the case circumaural or supra-aural earphone apparatus or earpiece in the case of in-ear/in-the-canal earphone apparatus) may be readily orientated in a predetermined position/orientation relative to the head simulator (e.g. relative to the ear plate). For example, the earphone unit positioning guide may be configured to set one or more of: a front position; a rear position; and a height position of the or each earphone unit. In one embodiment, the earphone unit position guide is configured to hold the earphone unit in the predetermined position (e.g. defines at least one earphone unit engagement guide surface). In one embodiment, the earphone unit positioning guide comprises one or more locating pins (e.g. front, rear and lower locating pins). In one another embodiment, the earphone unit positioning guide comprises one or more locating walls.

In one embodiment, the mounting guide system comprises means (e.g. sealing part) for applying an enhanced sealing force to an earphone unit (e.g. to ensure acceptable seal is formed between earphone unit and ear plate). Advantageously, the creation of a good seal between the earphone unit and head simulator allows accurate testing even in noisy factory environments. In one embodiment, the seal generated between the earphone unit and head simulator may be a stronger seal than that which would be achieved in normal use.

In one embodiment, the means comprises an ear plate having a profile (e.g. thickness) operative to cause a headband of the earphone apparatus under test to stretch beyond its normal range to generate an additional sealing force. In the case of a two-part ear plate, the thickness of the ear plate may be adjustable by replacing a detachable outer part of the ear plate with a first thickness with a further detachable outer part having a second thickness different to the first.

In one embodiment, the substantially planar earphone engagement surface is angled to minimise angular displacement between the headband and earphone unit. In this way, the resultant headband forces are applied substantially normal to the ear plate resulting in more even compression of the earphone unit cushion/pads around their periphery. Typically the angled surface will be achieved by an ear plate having a thickness that increases with increased distance from the headband. However, it is conceivable that for some headband/earphone unit combinations the ear plate may require a thickness that decreases with increased distance from the headband.

In one embodiment, the passageway extends normal to the angled face of the substantially planar earphone engagement surface. In this way the geometry of the ear simulator may be kept constant regardless of the angle of inclination.

In one embodiment, the means comprises clamping means (e.g. clamping part).

In one embodiment, the clamping means comprises a movable clamping member (e.g. pivotable biasing member or an advanceable screw-threaded biasing member).

In another embodiment, the clamping means comprises a static clamping member (e.g. relying upon resilience of the earphone unit to allow placement of earphone unit in position).

In one embodiment, the eardrum microphone is mounted at an opposed end of the passageway to the external opening.

In one embodiment, the head simulator further comprises an internal driver operative to generate a test signal. The internal driver may be mounted at an opposed end of the passageway to the external opening. The internal head simulator driver may be provided as part of a unit including the eardrum microphone.

In one embodiment, the head simulator further comprises at least one cheek-mounted microphone (e.g. left and right cheek-mounted microphones) for sensing externally generated sound. In one embodiment, the at least one cheek-mounted microphone comprises a sensor surface or a sensor inlet provided substantially in line with an outer surface of a cheek portion of the head simulator.

In one embodiment, the apparatus further comprises a mounting frame for at least one external loudspeaker (e.g. left and right external loudspeakers). The at least one external loudspeaker may be configured to generate a predictable external noise field (e.g. predictable near-field noise field).

In one embodiment, the test module comprises a processor (e.g. microprocessor).

In one embodiment, the test module comprises a signal interface operative to transmit audio signals to at least one driver (e.g. driver of the earphone apparatus being tested or driver of the test apparatus—e.g. internal driver of the head simulator or external loudspeaker) and receive measurement signals from at least one microphone (e.g. microphone of the earphone apparatus being tested or microphone of the test apparatus—e.g. eardrum microphone or cheek-mounted microphone of the head simulator). The test module may be configured to provide a multi-channel output and receive a multi-channel set of responses.

In one embodiment, the test module is configured to store one or more pre-generated test pattern.

In one embodiment, the test module is configured to store received measurement signals.

In one embodiment, the test module further comprises a control interface for connecting the test module to a control device.

In the case of an R&D environment, the control device is likely to comprise a personal computer and will be operative to provide a rich user interface consistent with the skill of the user and time available to the user.

In the case of manufacture (e.g. assembly line environment), the control device may comprise a specialist interface device (e.g. touchscreen device offering a sparse user interface).

In one embodiment, the control device is connected to a computer network (e.g. via the Internet). In this way the testing may be observed, controlled and updated centrally (and transparently), ensuring the integrity and security of the testing process.

In one embodiment, the test module further comprises an earphone test interface for communicating with the earphone apparatus. In this way, earphone apparatus including a corresponding communications interface (e.g. earphone device having multiple modes of operation and/or programmable features) may communicate direct with the test module to enable enhanced testing and configuration.

In one embodiment, the earphone test interface is operative to allow the test module to perform one or more of the following functions: power on/power off active earphone functionality (e.g. power on/power off ANR circuitry); provide digital logic signals to enable/disable: audio playback; active noise reduction; audio EQ; feed-forward noise reduction; binaural monitoring/talk through; instruct the earphone apparatus to enter a test mode (e.g. for earphone apparatus having multiple modes of operation); instruct adjustment of controllable parameters (e.g. alter or select digital parameters stored within the earphone apparatus during testing); transmit calibration or configuration constants determined during testing to the earphone apparatus (e.g. for storage in a memory of earphone apparatus).

In one embodiment, the earphone communications interface provides signals to the signal interface (e.g. to allow data available from the earphone apparatus that is of use to testing to be transmitted direct to the signal interface).

In accordance with a second aspect of the present invention there is provided, an automated method oftesting earphone apparatus during a production line manufacturing process comprising: providing test apparatus as defined in the first aspect of the invention (e.g. as defined in any embodiment of the first aspect of the invention; positioning earphone apparatus to be tested in a predetermined test position relative to the ear simulator; and running a program to perform to perform the steps of: a test phase comprising: activating a pre-generated test pattern (e.g. using one or more driver of the test apparatus or one or more driver of the earphone apparatus); and collecting at least one response (e.g. using one or more microphone of the test apparatus or one or more microphone of the earphone apparatus in the case of earphone apparatus including a communications interface communicable with the test apparatus); and an analysing step comprising analysing the at least one response.

In this way, an automated method of testing earphone apparatus is provided which is suitable for use in providing rapid testing in a production line manufacturing environment. Typically the method is implemented as a computer-implemented testing routine and will involve little user input after testing is initiated.

In one embodiment, the at least one response collected during the test phase is used to perform a first analysis stage (e.g. first series of analysis steps).

In one embodiment, the analysing step comprises one or more of: determining whether a determined property of the earphone apparatus falls within an acceptable range; determining a value for calibrating or adjusting a programmable earphone apparatus; performing diagnostic analysis; and collecting response data (e.g. for centralised analysis).

In one embodiment, the method further comprises performing at least one further test phase comprising a further activating step and a further collecting step.

In one embodiment, the at least one further test phase occurs after the first-defined test phase is completed.

In one embodiment, the at least one response collected during the at least one further test phase is used to perform a second analysis stage (e.g. second series of analysis steps).

In one embodiment, the second analysis stage (e.g. second series of analysis steps) uses data from the at least one response collected during the first-defined test phase and/or results from the first analysis stage (e.g. first series of analysis steps). In this way, the speed of multi-stage testing may be increased by reducing the number of test phases.

In one embodiment, the first analysis stage is conducted before the at least one further test phase is initiated.

In the case of programmable earphone apparatus, the method may further comprise programming the earphone apparatus as a result of the analysing step.

In one embodiment, the method comprises (step 1) identifying the earphone apparatus to be tested (e.g. by scanning a barcode label or reading a unique identifier provided on the earphone apparatus) and providing a test prompt to an operator.

In one embodiment, the analysis step may comprise one or more of: a receiving response check; a receiver polarity check; a plant response check; a plant phase check; a plant fitting check; a gain adjust limit check; a feedback ANR check; an EQ response check; and a balance test.

In the case of the receiving response check, the method may comprise: a test phase comprising: selecting a pre-generated internal test pattern; activating the pre-generated internal test pattern using the driver of the earphone apparatus to be tested; and measuring the response of the eardrum microphone; and the analysis step comprises calculating the ratio of pressure at the eardrum microphone to voltage applied to the driver of the earphone apparatus based on the measured response and a determined voltage at the driver of the earphone apparatus being tested, and comparing the ratio with a predetermined reference value.

In one embodiment the voltage at the driver of the earphone apparatus is measured direct using the communications interface of the earphone apparatus. In another embodiment, the voltage at the driver of the earphone apparatus is determined by with reference to an excitation voltage known to be input to the earphone apparatus by the pre-generated internal test pattern and a known transfer function from the input to the driver terminals. In this way, the voltage at the driver may be inferred and the receiving response estimated.

In the case of the receiver polarity check, the analysis step may comprise checking a phase component of the measured receiving response for correct polarity.

In the case of the plant response check, the test phase may comprise: measuring the response of the feedback microphone of the earphone apparatus being tested to the pre-generated internal test pattern when supplied using the driver of the earphone apparatus to be tested (e.g. with the measurement being conducted concurrently with the measurement in step 1); and the analysis step may comprise calculating a ratio of detected pressure at the feedback microphone to voltage applied to the earphone driver.

In the case of the plant phase check, after determining the plant response, the method may comprise a further analysis step comprising determining a plant phase associated with the plant response and comparing the identified plant phase with a predetermined reference value.

In the case of the plant fitting check, after determining the plant response, the method may comprise a further analysis step comprising determining the measured magnitude of the plant response at a critical frequency (e.g. a frequency chosen to emphasise the acoustic/electro-acoustic variability between manufactured samples and to minimise any sensitivity to electronic variability) and computing a required setting of loop gain for the earphone apparatus under test. The required setting of loop gain may then be compared against allowed limits to test for appropriateness.

In the case of the feedback ANR check, the method may comprise: repeating the test phase and analysis step of the receiving response check with the feedback ANR functionality enabled; and in a further analysis step determining the level of ANR feedback by comparing the difference between the two calculated receiving responses and comparing the determined level of ANR feedback with a predetermined design target.

In the case of the EQ response test, the method may comprise: repeating the test phase and analysis step of the receiving response check with the EQ filter enabled; and in a further analysis step determining a frequency response of the EQ filter by comparing the difference between the two calculated receiving responses and comparing the determined frequency response with a predetermined design target.

In the case of the balance test, in a first step (ANR Off), the method may comprise an analysis step comprising: calculating left/right audio balance with feedback ANR functionality disabled using the calculated receiver response for the left and right channels; and comparing the calculated left/right audio balance with a predetermined reference value. In a second step (ANR On), the method may comprise an analysis step comprising: calculating left/right audio balance with feedback ANR functionality enabled using the calculated receiver response, feedback ANR and EQ response for each of the left and right channels (e.g. by taking the receiving response calculated in the first step and calculating the modifications imposed by the feedback ANR and EQ response); and comparing the calculated left/right audio balance with a predetermined reference value.

In the case of earphone apparatus comprising a feedforward microphone (e.g. for forward-path applications such as feed-forward ANR control and/or binaural monitoring/talk-through), the analysis step may comprise one or more of: a binaural monitor operation check; a binaural sealing check; a feedforward sensitivity check; a feedforward plant response check; a feedforward ANR set-up step; and a feedforward gain adjust limit check.

In the case of the binaural monitor operation check, the method may comprise: a (e.g. further) test phase comprising: selecting a pre-generated external test pattern; activating the pre-generated external test pattern (e.g. using at least one external loudspeaker provided on the head simulator) whilst the binaural monitoring function is disabled and measuring a first transfer function from the cheek-mounted head simulator microphone to the eardrum microphone; activating the pre-generated external test pattern (e.g. again using the at least one external loudspeaker provided on the head simulator) whilst the binaural monitoring function is enabled and measuring a second transfer function from the cheek-mounted head simulator microphone to the eardrum microphone; and an analysis step comprising comparing the ratio of the first and second transfer functions (e.g. by comparing the magnitude of the first and second measured transfer function) to a predetermined reference value.

In the case of the binaural sealing check, the method may comprise: a further test phase in which binaural monitoring is enabled (e.g. in the case of a programmable earphone apparatus) with a gain setting at an elevated test level (e.g. abnormally high level) and re-measuring the receiving response; and an analysis step comprising comparing the re-measured receiving response with the originally measured receiving response. A disturbance in the measured receiving response would indicate a leakage path from the receiver to the feedforward microphone. Typically the measuring of the receiving response with the gain setting at the elevated level will occur after an initial measurement of the receiving response, but the ordering could be reversed.

In the case of the feedforward sensitivity check, the method may comprise: a (e.g. further) test phase comprising: selecting a pre-generated external test pattern; activating the pre-generated external test pattern (e.g. using at least one external loudspeaker provided on the head simulator) and measuring the response of the feedforward microphone of the earphone apparatus under test; and an analysis step comprising comparing the response of the feedforward microphone of the earphone apparatus to a predetermined reference value. In one embodiment, the test phase comprises measuring the response of the cheek-mounted head simulator microphone and the analysis step comprises comparing the difference between the feedforward microphone and cheek-mounted head simulator microphone responses to a predetermined reference value.

In the case of the feedforward plant response check, the method may comprise: a (e.g. further) test phase comprising: selecting a pre-generated external test pattern; activating the pre-generated external test pattern (e.g. using at least one external loudspeaker provided on the head simulator) and measuring the responses of the feedforward microphone of the earphone apparatus under test and the eardrum microphone; and an analysis step comprising determined a transfer factor between the feedforward microphone of the earphone apparatus under test and the eardrum microphone based on the measured responses and comparing the determined transfer factor with a predetermined reference value.

In the case of the feedforward ANR set-up step, the method may comprise an analysis step comprising: using the determined receiving response and the determined feedforward plant response to generate a model of feedforward ANR performance; identifying from the model a suggested value of optimal feedforward gain; and programming the earphone apparatus under test with the suggested value of optimal feedforward gain.

The feedforward ANR set-up step may further comprise: a (e.g.) further test phase comprising: selecting a pre-generated external test pattern; activating the pre-generated external test pattern (e.g. using at least one external loudspeaker provided on the head simulator) whilst the feedforward ANR function is disabled and measuring a first transfer function from the cheek-mounted head simulator microphone to the eardrum microphone; activating the pre-generated external test pattern (e.g. again using the at least one external loudspeaker provided on the head simulator) whilst the feedforward ANR function is enabled and measuring a second transfer function from the cheek-mounted head simulator microphone to the eardrum microphone; and an analysis step comprising comparing the ratio of the first and second transfer functions to a predetermined reference value. This method may be repeated with a new suggested value of optimal feedforward gain in an automated iterative process to identify an optimal feedforward gain value.

In the case of the feedforward gain adjust limit check, the method may comprise programming the earphone apparatus under test with the optimal feedforward gain value identified in the feedforward ANR set-up step. The degree of difference (e.g. magnitude of difference) between the proposed gain adjustment and a designed default gain may then be calculated and compared with allowed limits (e.g. to test for a viable solution).

For stereo earphone apparatus, typically both left and right channels of the earphone apparatus will be tested. Accordingly, with the exception of the left/right audio balancing steps, each of the steps defined above may be carried out (e.g. simultaneously) for both the left and right channels.

Embodiments of the present invention will now be described by way of example with reference to the accompanying drawings in which.

THE HATS DEVICE

Figure 1:
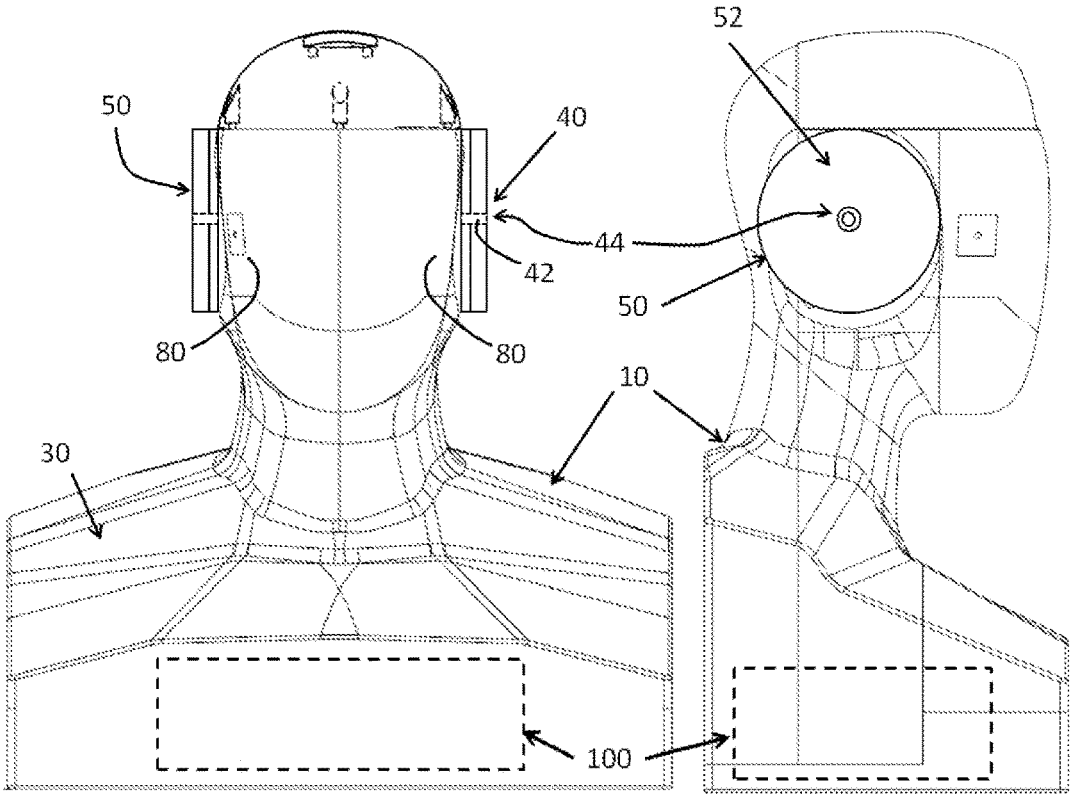
FIG. 1 is a schematic illustration of test apparatus in accordance with an embodiment of the present invention.
Figure 2:
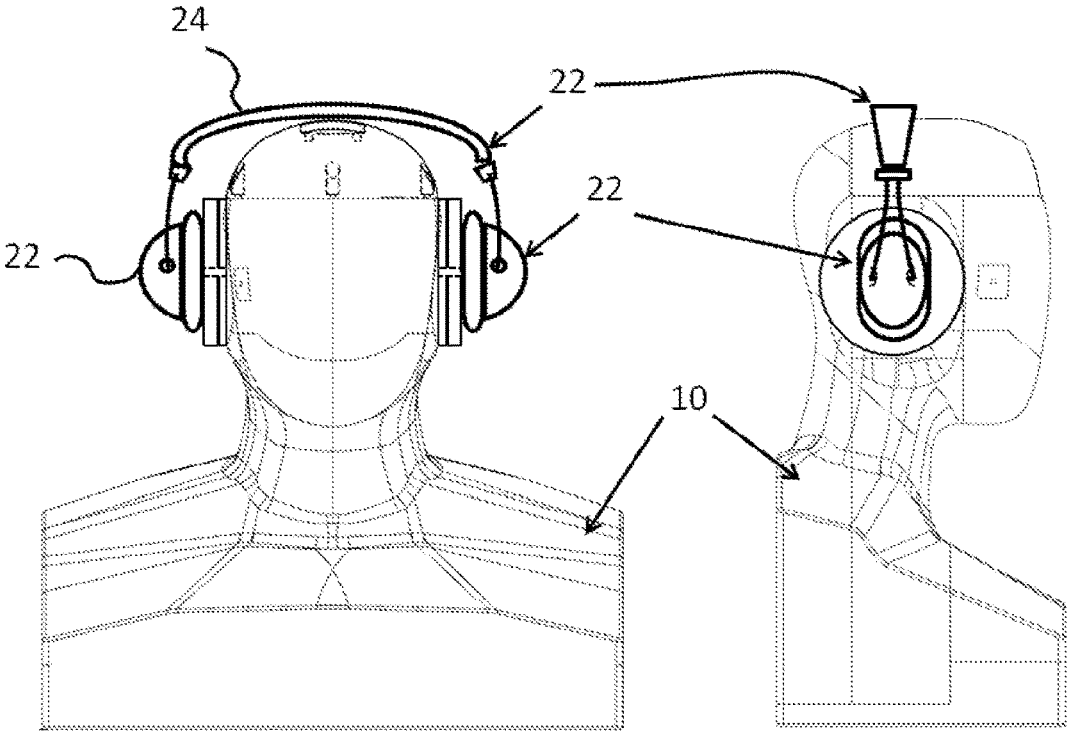
FIG. 2 is a schematic illustration of the test apparatus of FIG. 1 with a set of headphones in a test position.

FIGS. 1 and 2 show test apparatus 10 for testing headphones 20 during manufacture, test apparatus 10 comprising a HATS device 30 simulator including an ear simulator 40 and a test module 100 for performing rapid automated testing of headphones mounted 20 when mounted in a test position on HATS device 30. Ear simulator 40 comprises a simple, plate-form ear plate, 50, defining a substantially planar earphone engagement surface 52 substantially encircling a central opening, 44, to an artificial ear (or simple eardrum microphone 46). Advantageously, the planar earphone engagement surface 52 of ear plate 50 offers advantages in allowing a headphone system to demonstrate nominal performance upon first placement—clearly an advantage in a production or testing context, where time and operator skill is in short supply.

Figure 3:
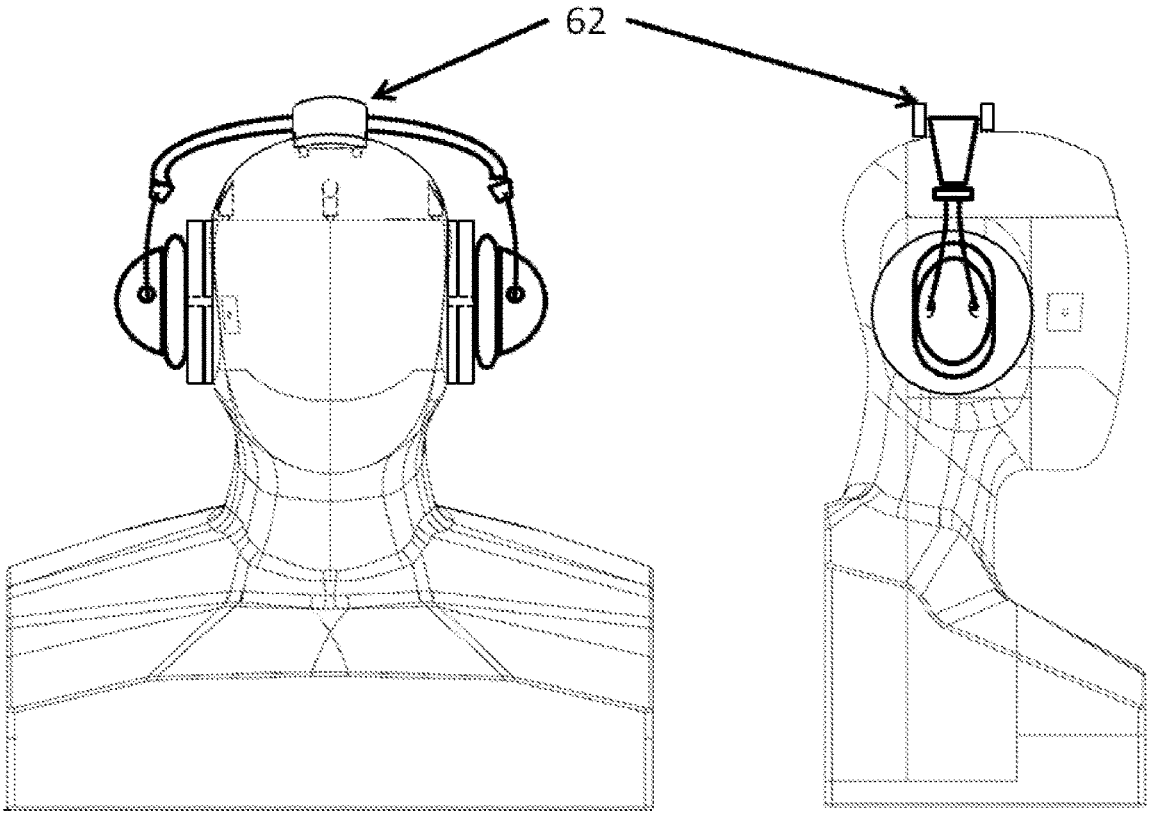
FIG. 3 is a schematic illustration of the test apparatus of FIG. 1 showing a first embodiment of an optional mounting guide system.
Figure 4:
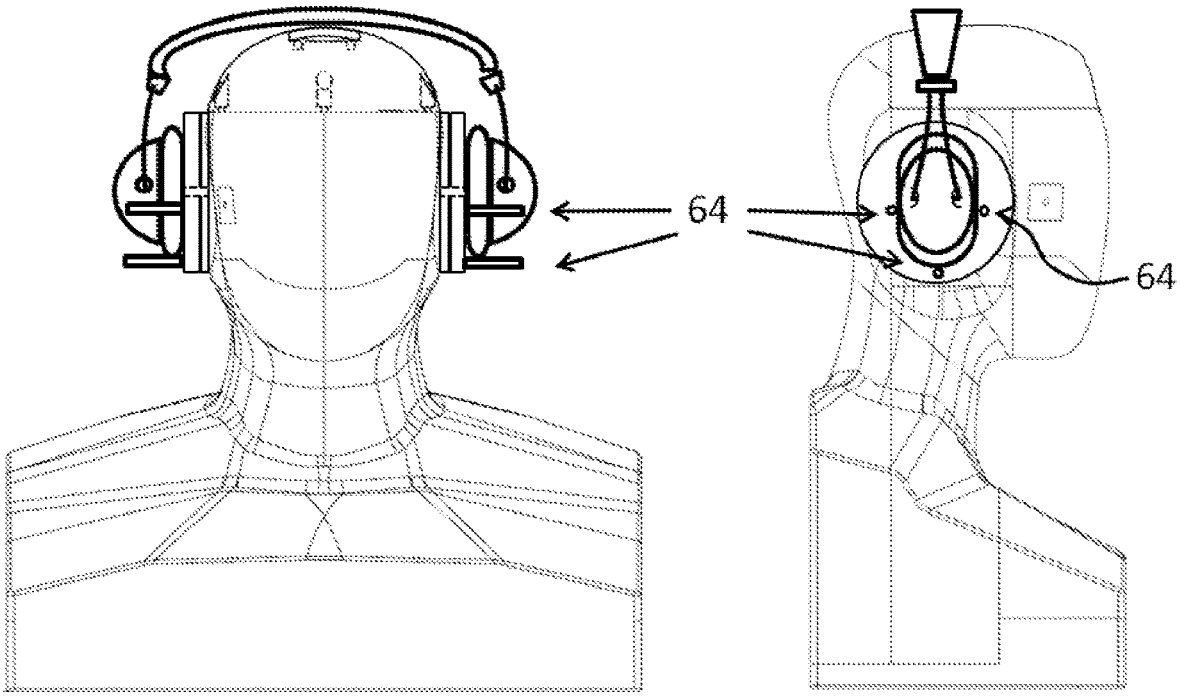
FIG. 4 is a schematic illustration of the test apparatus of FIG. 1 showing a second embodiment of an optional mounting guide system.
Figure 5:
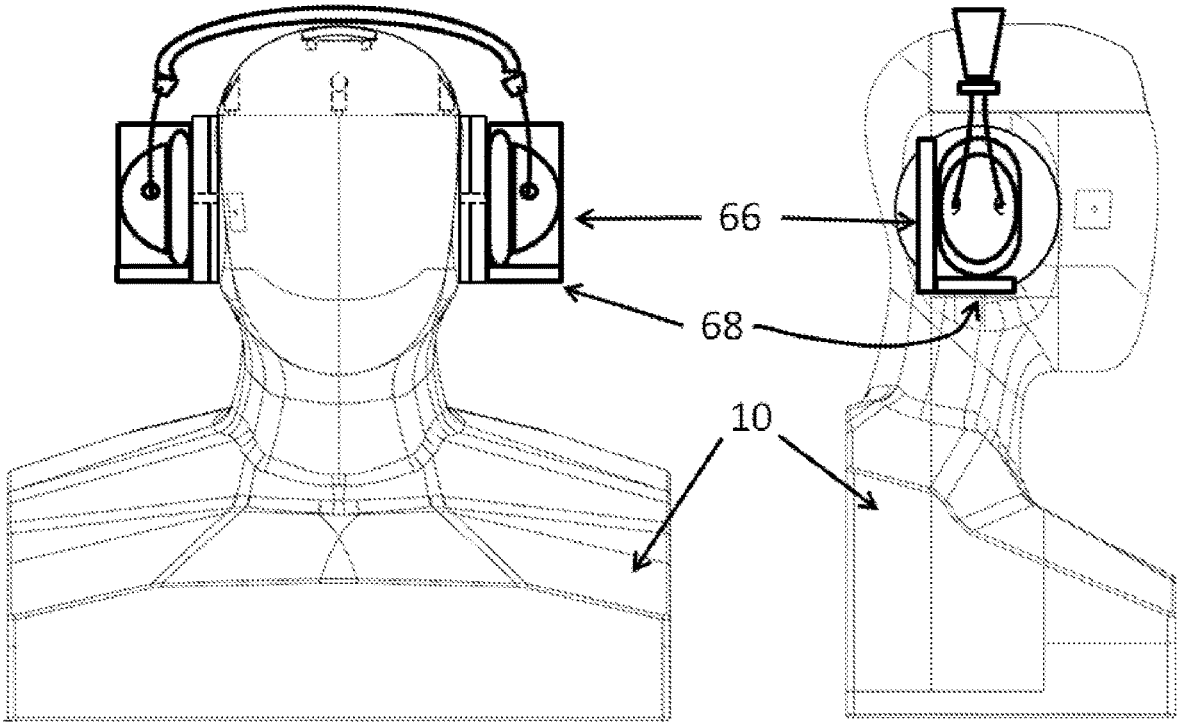
FIG. 5 is a schematic illustration of the test apparatus of FIG. 1 showing a third embodiment of an optional mounting guide system.

FIGS. 3-9 illustrate a range of mounting guides forming part of a mounting guide system, including headband positioning guides (fitted to the crown of the HATS device 30), such as the u-channel fixture, 62, illustrated in FIG. 3, locating pins, 64, (fitted on ear plate 50, to correctly locate headphone 20 relative to the ear), as illustrated in FIG. 4 and locating walls, 66 & 68, (extending from ear plate 50, to correctly locate headphone 20 relative to the ear), seen in FIG. 5 which further assist in extending the usefulness of this new class of HATS device 30, particularly in the time-sensitive context of manufacture.

Figure 6:
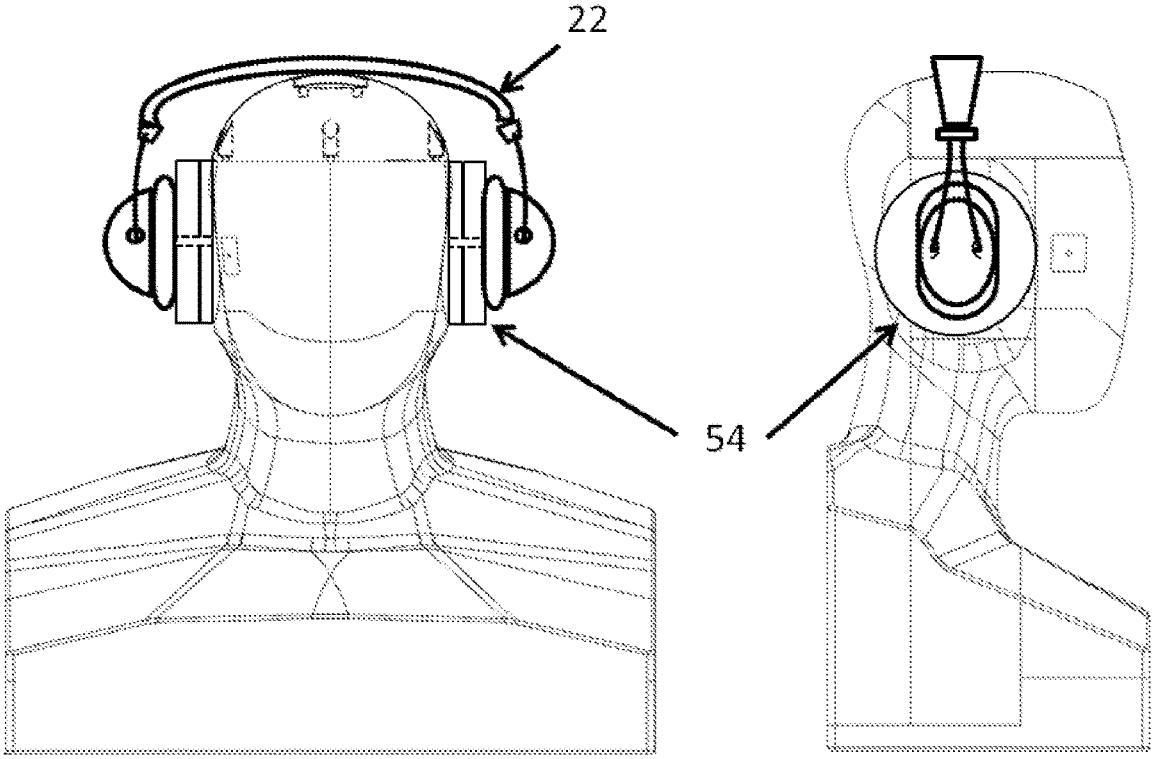
FIG. 6 is a schematic illustration of the test apparatus of FIG. 1 showing a fourth embodiment of an optional mounting guide system.
Figure 7:
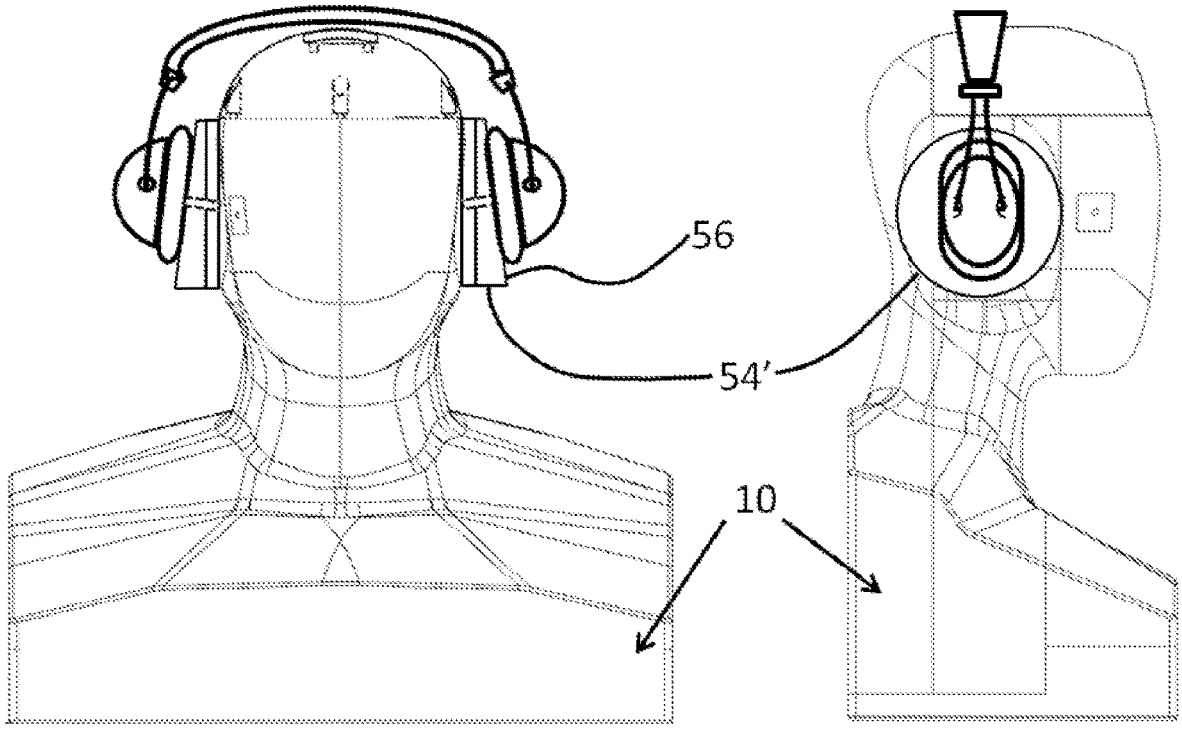
FIG. 7 is a schematic illustration of the test apparatus of FIG. 1 showing a fifth embodiment of an optional mounting guide system.

The headphone system's performance is modified by the degree of clamping force generated by the strain imposed on its own headband 24 as it is extended to stretch over the head from its default position. If this is insufficient to achieve an appropriate seal for useful measurement (in potentially noisy factory conditions where the go/no-go tests of outgoing quality control may take place), then the new HATS device 30 may be fitted with specially thickened ear plates, 54, which have the consequence of requiring the headband, 22, to stretch further than the anthropometric mean distance between ears—thereby generating a higher force sealing the headphone cushion to the ear plate, as illustrated in FIG. 6. These thickened ear pates, 54', may optionally be fashioned with an angled face, 56, such that—when mounted on the HATS device 30—the two ear plates 50 are not parallel. This may be preferred to ensure that the resultant headband forces act substantially normal to the ear plate 50, causing equal compression of the headband cushion, as is illustrated in FIG. 7.

Notwithstanding the change in thickness or angle of the ear plate, the size, relative position and acoustic behaviour of the artificial ear remains constant. This is achieved by the artificial ear being carried in (or actually implemented in) the modified ear plate itself, such that the location of the opening of the (artificial) ear canal may optionally be defined by the surface of the ear plate and the canal may optionally be normal to the surface of the ear plate. Thus, as the ear plate is changed in thickness or angle, the artificial ear moves with it, preserving its position relative to the headphone under test.

Figure 8:
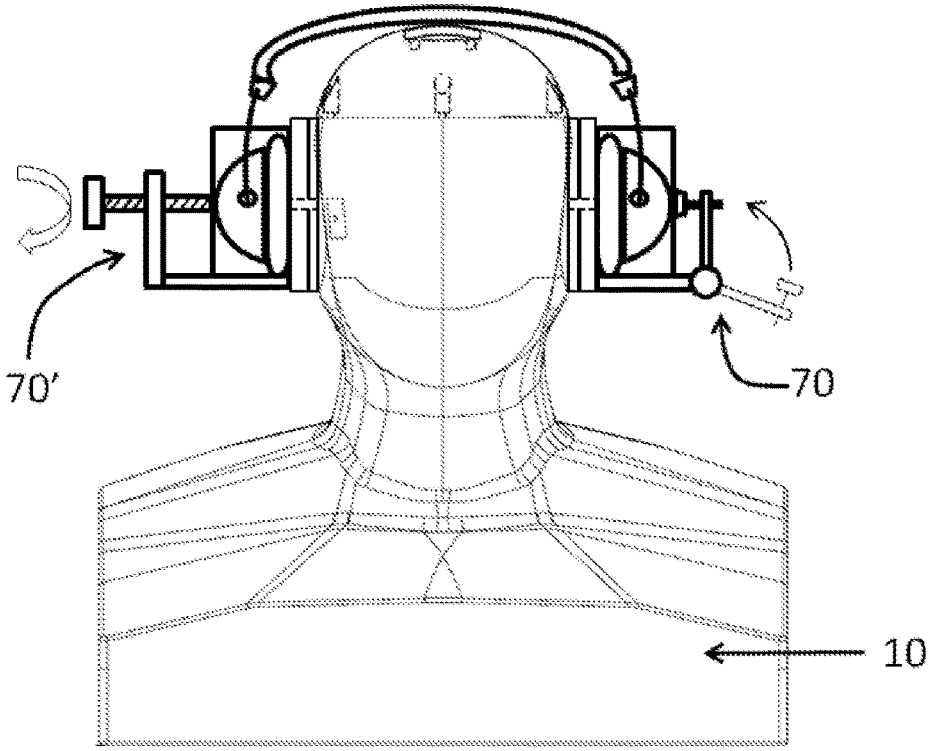
FIG. 8 is a schematic illustration of the test apparatus of FIG. 1 showing a seventh embodiment of an optional mounting guide system.
Figure 9:
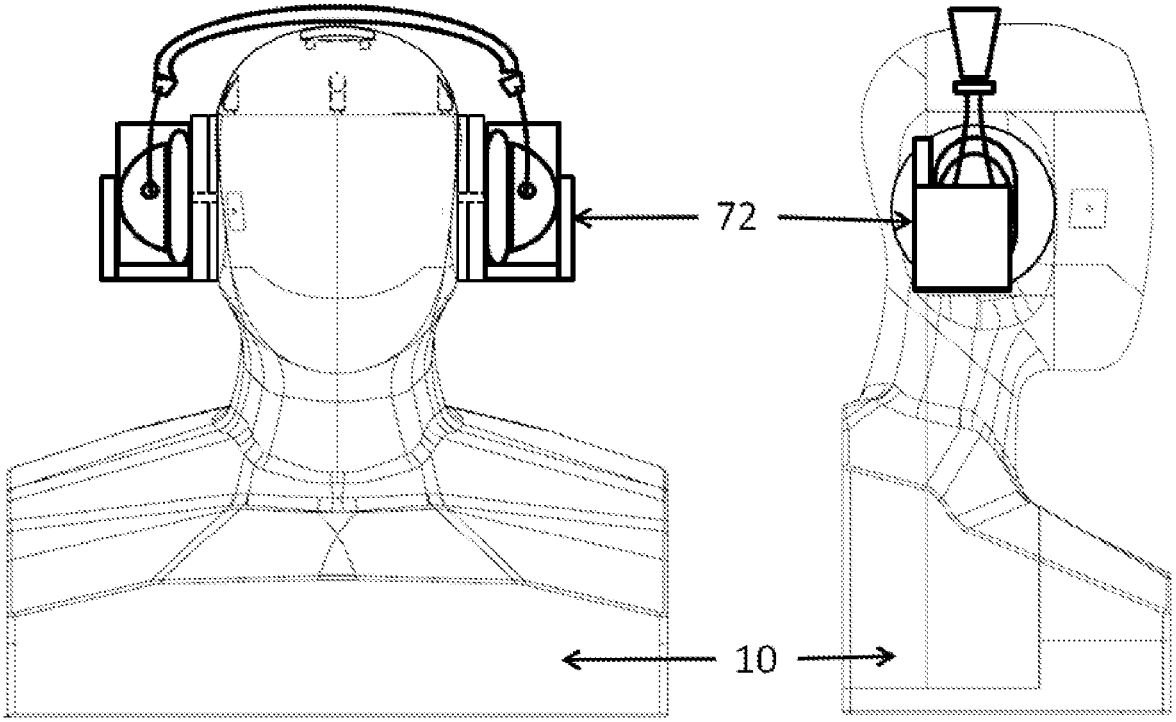
FIG. 9 is a schematic illustration of the test apparatus of FIG. 1 showing an eighth embodiment of an optional mounting guide system.

Alternatively, there may be provided clamping means in the form of a clamping device 70' to compress the headphone shells against the ear plate 50 after correct positioning, or toggle clamps, 70, illustrated in FIG. 8. Alternatively, the "wall" construction, described previously as means to provide location relative to the ear opening on the ear plate, may be elaborated by the provision of a further member parallel to the ear plate 50, to form an open box construction, 72, shown in FIG. 9. Upon inserting the headphone 20 into position on the HATS device 30 with this fixture, the headphone 20 is both located and clamped. The design of the clamping means or of the open box is such that speed of mounting the headphone onto the HATS device 30 is not compromised in the manufacturing context.

It is understood that the provision of all the bespoke positioning and clamping devices described above required detailed knowledge of the geometry of the device to be tested and is—as such—a strategy to be deployed during the evaluation of a device in mass production.

The HATS device 30 is capable of being fitted with ear plates 50 which mount standard artificial ears/ear simulators (such as IEC 711 occluded ear simulators) and the external pinnae associated with the use of such devices in telephonometric tests (such as defined in ITU-T P57). However, this is an unusual use case of the HATS device 30, which, in preferred mode of use, is fitted with ear plates 50 having a plane external surface, 52, devoid of any external pinna, and a simplified ear simulator. The simplified ear simulator usually amounts to little more than a cylindrical tube, 42, modelling the external auditory meatus, offering an equivalent acoustic volume approximating that of the ear (but not seeking to exactly match it), at the proximal end of which (i.e. the 'eardrum position') is mounted a pressure microphone in the form of eardrum microphone 46.

The Electro-Acoustic Transducers

The assembly of eardrum microphone 46 acoustically seals the proximal end of the tube (thereby forming an acoustically sealed volume under the headphone 20 when it is mounted on the HATS device 30). The microphone assembly is demountable from the ear plate 50, to facilitate replacement or calibration in a conventional acoustic calibrator. The eardrum microphone 46 may be realised using Silicon 'MEMS' technology or other well-rehearsed transducer means. The microphone may produce conventional analogue output or offer direct digital output.

The frequency response of eardrum microphone 46 and absolute pressure sensitivity will be well-understood and calibrated before and during operation of the test system. Whilst it is possible to operate the system with a calibration referenced to a notional equivalent free-field pressure (that acoustic pressure which would exist in the absence of the test fixture, were an acoustic wave passing the test location in unobstructed conditions), the test system is more usually used to make measurements of difference in pressure response observed when the headphone under test is placed in two different condition. In this case, both the existence of a reference condition and the significance of absolute pressure calibration become less important, as data is derived from difference between the two observations alone.

In addition to the eardrum microphone 46, the proximal end of the simplified artificial ear may also be equipped with an acoustic source in the form of internal HATS driver 48.

Figure 10:
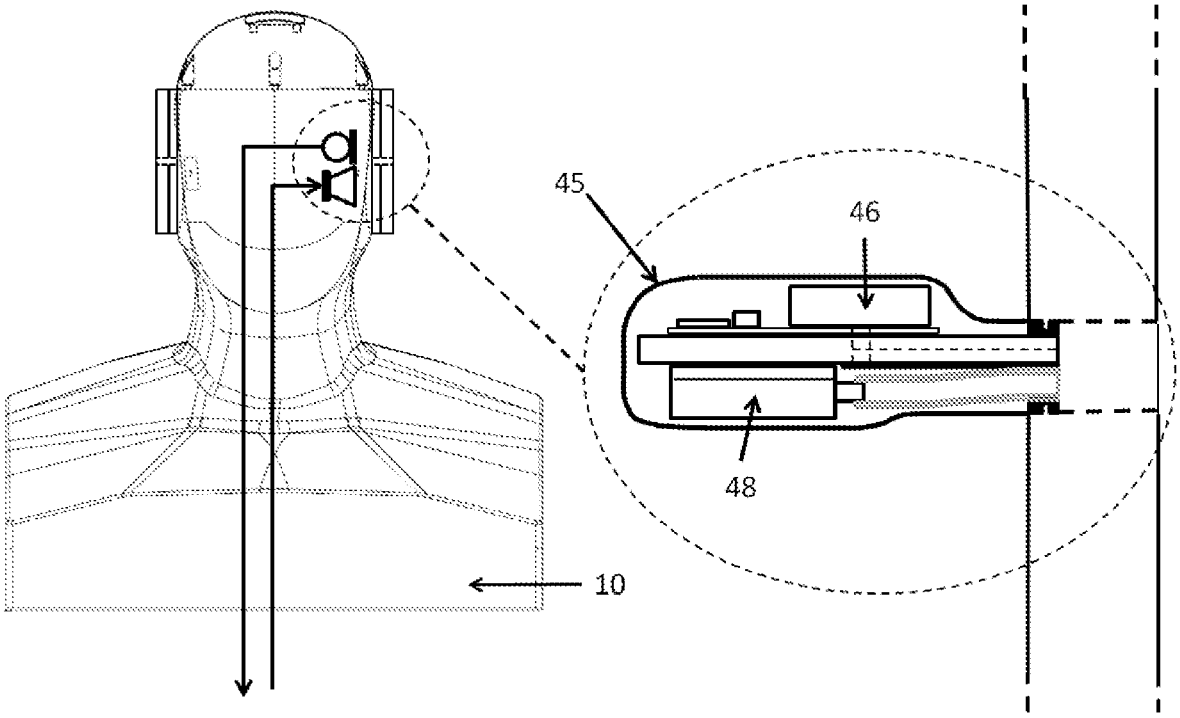
FIG. 10 is a schematic illustration of the test apparatus of FIG. 1 showing details of the ear simulator.

Internal HATS driver 48 may be used to generate sound for the purpose of testing eardrum microphone 46 or for providing an acoustic test signal for other tests on a headphone under test where the headphone's own integrated sound source cannot conveniently be used (for example, in cases where the internal architecture of the headphone under test does not permit signal access to the integrated sound source without activation of internal electronic circuits). This sound source may be realised using Balanced Armature, Piezoelectric or similar electro-acoustic technologies, which are well known and suitable for implementation on a dimensional scale appropriate for this application. The integration of internal HATS driver, 48, and eardrum microphone, 46, into the HATS 'ear drum' location may conveniently be achieved as a single unit 45 using the applicant's 'substrate' technology as illustrated in FIG. 10 as described in WO 2012/120295. Internal HATS driver 48 may be a passive or active device and may accept signals in analogue or digital input form.

Figure 11:
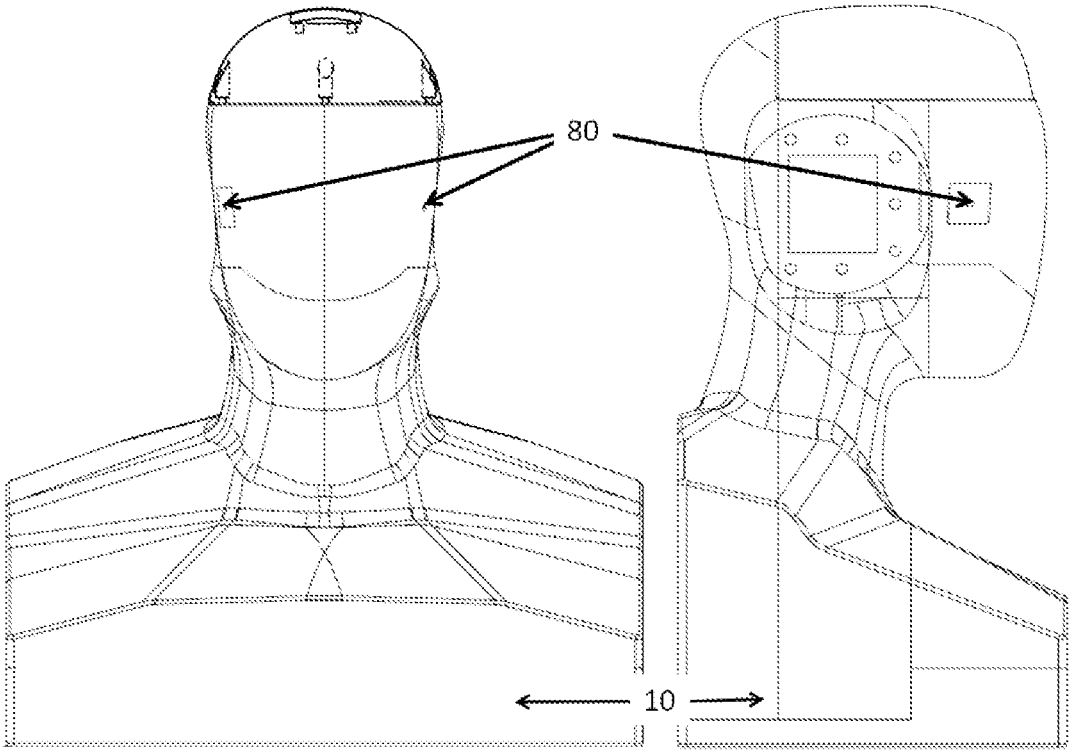
FIG. 11 is a schematic illustration of the test apparatus of FIG. 1 showing details of the cheek-mounted microphones.

In addition to eardrum microphone 46 (and optional sound source 48) positioned at the "ear drum" position, 46, the HATS device 30 is provided with microphones 80 located on each of the cheeks as illustrated in FIG. 11. These cheek-mounted microphones 80 may be realised in any of the similar technologies to those in the simplified artificial ears. It is the purpose of cheek-mounted microphones 80 to sense a pressure external to any mounted headphone system, yet strongly 'handed' to left or right side of the head and, thereby, well-correlated with the pressure that might be detected by microphones mounted on the anterior face of the headphone shells. Such microphones typically are used to provide voice pickup for telephony (as the anterior face of the shell is closer to the mouth) and ambient sound pickup for "binaural listening" or "talk-through" (as the anterior facing microphone placement mimics some of the directionality of the un-occluded outer ear). Microphones on the anterior face of the headphone under test's shell may also be used to provide signals for feed-forward active control (if these microphones are shared with telephony or Binaural Monitoring function).

In order to provide acoustic sealing, but importantly to ensure mechanical strength, acoustic components including the microphone assemblies noise immunity filters, cable connections, and screw/wave guide elements may be provided in one or more over-molded units. The over-molding uses a low-pressure, low temperate process to over-mold the polymer material on the subassembly without effecting the sensitive acoustic components mounted on the chassis.

Figure 12:
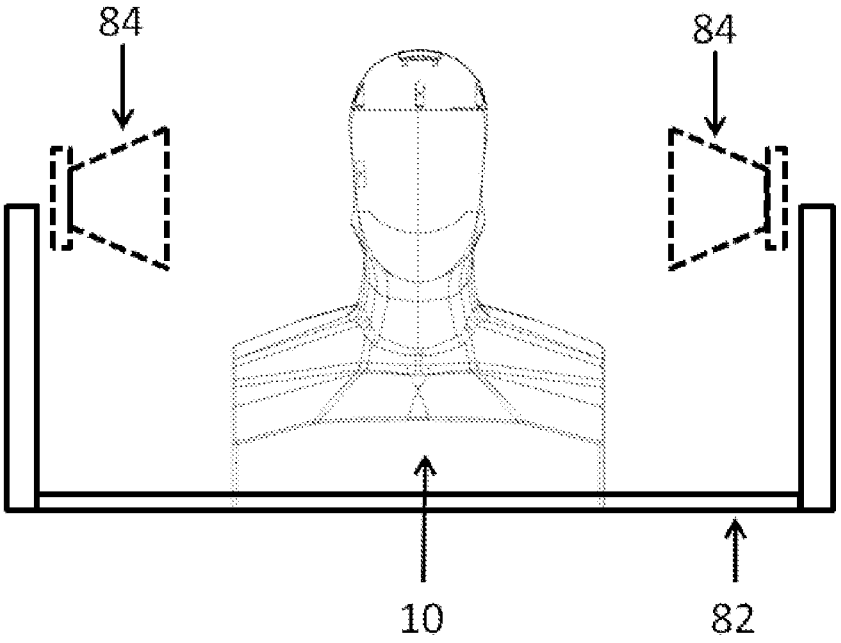
FIG. 12 is a schematic illustration of the test apparatus of FIG. 1 with an optional loudspeaker mounting system.

HATS device 30 is augmented by a proprietary base, 82, shown in FIG. 12, which forms a mounting frame to position loudspeakers, 84, on each side of the main HATS device, 30. These loudspeakers, 84, may be active devices, incorporating their own power amplifiers and may accept signals in either analogue or digital form. It is appreciated that the provision of a robust stand system is more than a convenience—the fixed, consistent, defined relative location of the loudspeakers is important to correct functioning of the test protocol over time.

Loudspeakers, 84, are used in certain test steps, where a defined, reliable external noise field is required. The headphone 20 under test and the HATS device 30 are operated in close proximity to loudspeakers 84 and are—in consequence—located in the near field of the loudspeakers' radiation. Accordingly, the performance reported by the system is not representative of the performance is expected in all conditions (particularly the random incidence, free-field conditions more typical of hearing protector testing). Accordingly, intelligence is required in deploying the test in this configuration, in interpreting the results and in tuning the headphone in light of the results obtained.

The HATS device 30 may be machined from solid ABS, which provides a neutral, inert, non-conductive, certified green material of sufficient mass to attenuate ambient vibrations from the manufacturing environment, so as to cause fewer disturbances to the sensitive measurements taking place at the ear.

The ear plate 50 may be formed as a two-part assembly as illustrated by means of a fixed plate permanently attached to the HATS device 30 and then a product-specific plate which marries to it via a uniform coupling sealed with an O-ring to provide acoustic integrity.

The Integrated Electronics

Figure 13:
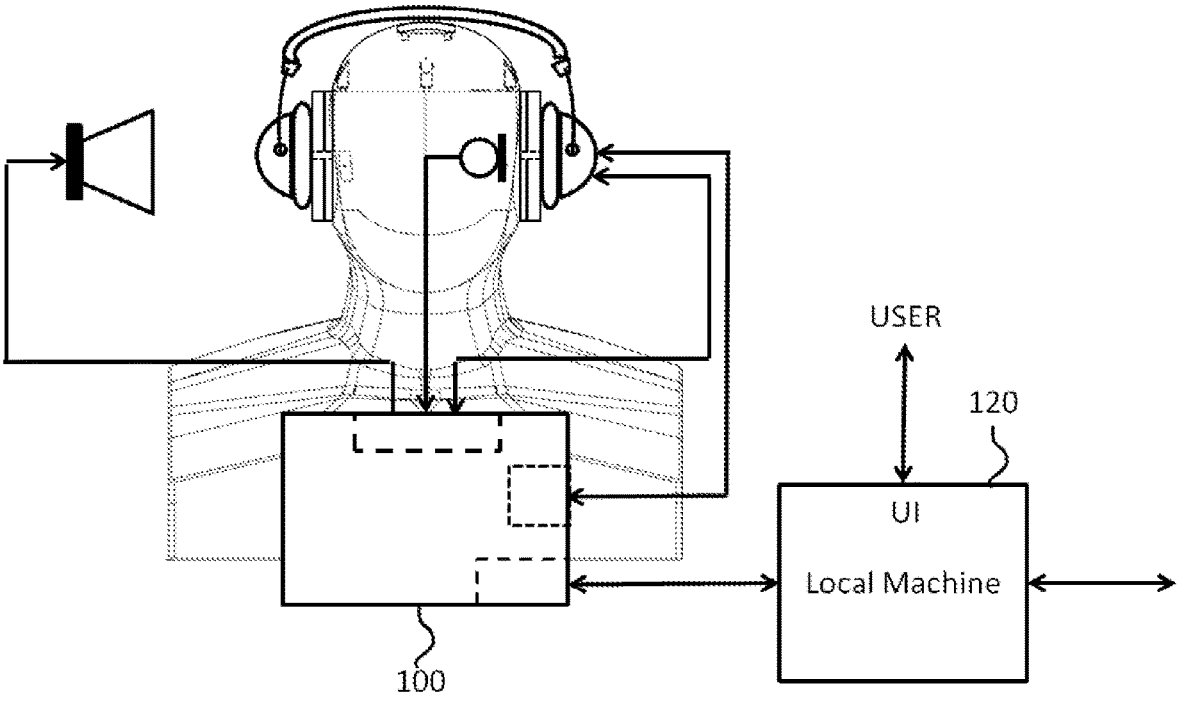
FIG. 13 is a schematic illustration of the test apparatus of FIG. 1 with the test module connected to a local computer device.

Inside the 'torso' of the HATS device 30 (which has been made especially large to accommodate this function) is housed new, proprietary electronics, 100, illustrated in FIG. 13. The back of the torso also accommodates a metal panel to locate a set of electrical connections to facilitate interconnections between elements of the system, as required.

Figure 14:
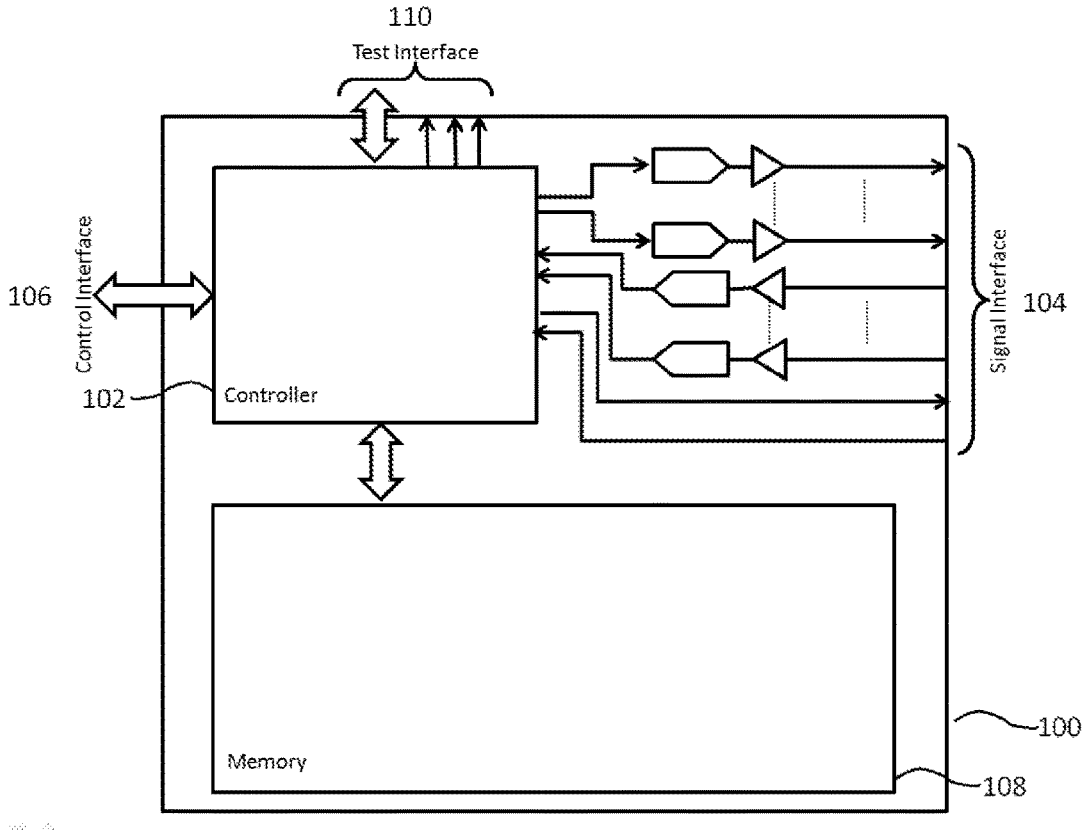
FIG. 14 is a schematic illustration of the test module of the test apparatus of FIG. 1.

The Integrated Electronics features three major interfaces: a signal interface, 104, a control interface, 106, and a test interface, 110. These interfaces are seen in FIG. 14.

The Signal Interface

The features of the acoustic measurement system as previously described imply some core audio-frequency measurement tasks, which may be resourced in whole or in part by electronics integrated into the HATS device 30. These measurement tasks require the generation, amplification, acquisition and capture of segments of multi-channel audio signals at high amplitude resolution and high bandwidth. Although some of these tasks may be performed (to a limited extent) within conventional consumer or industrial computers, the requirement for multi-channel operation and synchronous signal capture has motivated the development of a new electronic platform optimised to this task. It allows for multi-channel, output of a pre-generated set of test patterns and the synchronous capture of a multi-channel set of responses. The outputs can be routed through high-resolution digital-to-analogue converters, suitable for use with analogue sound sources or remain in digital format for use with digital devices. The signals may alternatively be applied to format converters or translated or modulated for communication via other media, including wireless, optical or other distribution means. The inputs can be collected via high-resolution analogue-to-digital converters or directly from digital output devices. The analogue outputs may be routed through reconstitution filters, programmable gain stages and line drivers or power amplifiers, capable of driving headphones or loudspeakers. The analogue inputs are passed through input stages having anti-aliasing filters and programmable gain amplifiers.

By these means, the integrated electronics are able to couple directly to transducers in or around the new HATS device, 30, (the microphones in the simplified artificial ear, 46, and the cheek, 80, any sound sources in the ear, 48, and the speakers 84 mounted either side of the HATS device, 30). By these means, the integrated electronics, 100, also is able to couple directly, to any accessible signal(s) on the headphone-under-test, 20. Further, any new headphone system be provided with its own communications interface in order intentionally to enhance and facilitate such interface with the integrated electronics via a test interface 110. The test interface, 110, shall be described in greater detail, below.

In addition to the means to support the signal interfaces, 104, described above, it is evident that the integrated electronics, 100, require considerable memory, 108 (seen in FIG. 14) to enable the storage of the signals, which pass over the signal interfaces, 104. There is first the memory required to store the pre-generated excitation patterns and second the memory required to store the responses that are elicited from the headphone under test and detected by the microphones (46, 80) either in the HATS device 30 or integral to the headphone under test.

In the simplest embodiment of this system, the excitation patterns are of duration of order ten seconds and there are 14 channels of input and output, each sampling at 96 kHz and the amplitude is quantised to 16-bit resolution. This corresponds to the order of 20 MB of data, which implies a data transmission rate faster than can be supported over (e.g.) an I2C interface if real-time signal communication over the interface, 104, is contemplated (thereby justifying the decision to provide for a localised data generation/capture system, as opposed to trying to manage the operation on general-purpose hardware).

The Control Interface

The Integrated Electronics, 100, includes no user interface or controls of any kind. Instead, the Integrated Electronics offers an interface to a uniform machine, which is capable of presenting a user interface (UI) by which the system may be controlled by its operator. This control interface, 106, is usually a wired link to a local machine, 120.

In applications within a Research and Development context, where the operator will be a Technician or Engineer, the local machine, 120, will typically be a personal computer system and the user interface will be rich or the user may have open access to the internal resources of the system. In applications within a manufacturing context, where the operator may have limited time/skills, the local machine will be an industrial computer and the user interface will be sparse.

The manufacturing interface has some novel characteristics to allow use during normal operation by low-skilled operators, but during commissioning and calibration times by highly-trained operators.

The sparse UI may provide a) a picture of the headphone under test showing the correct mounting on the HATS device, b) a status message showing the TESTING/PASS/FAIL state of the headphone under test, and c) a start button. Written text is kept to a minimum. When text pertinent to the operation of the system is presented, it is presented in the operator's native language. Once the operator mounts the headphone under test and starts the test, the test begins the sequence of test phases and measurement automatically without any intervention required by the operator until the test is completed.

The language of the UI is changed by a one-touch feature. By touching the screen at a predetermined area, the machine's presented language is automatically switched between the operator's native language and a supervisor language. This switching takes place without restarting the machine and without interrupting the operation of the system.

A technical UI can be accessed by an Engineer or Technician independently of the operation of the machine by the operator without interrupting the operation of the system. An Engineer or Technician on the same network subnet as the machine connects to a network port on the machine via TCP/IP upon which an encrypted protocol runs. Encryption serves two purposes: 1) to prevent eavesdropping of data between the machine and the Engineer; 2) to provide authorisation for the connection; and 3) to prevent a malicious third party from impersonating an Engineer by providing an imitation of a real connection.

Once connection is established, the Engineer is able to 1) observe in realtime detailed measurement results captured by the machine; 2) recalibrate and/or configure the system; 3) prevent the operator from making further tests; 4) present messages to the operator in his native language and/or the supervisor language; 5) make local copies of detailed measurement data for offline processing in other engineering tools.

The control interface, 106, is used to allow the local machine, 120, to supervise the activities of the Integrated Electronics, 100—either by the liberal interventions of the R&D Engineer or through the strictly pre-defined scripts that run on the industrial computer, operated by the manufacturing worker. The local machine, 120, designs and loads the excitation patterns into the Integrated Electronics' memory, 108, configures the signal paths, sets up the test interface, 110 (see below), triggers the test, reads back the elicited responses from memory and computes the parameters to be derived from the measurement.

The Test Interface

In addition to the signal interface, 104, the integrated electronics includes an earphone test interface, 110, communicable with the communications interface of the headphone under test, 20. It is the purpose of this earphone test interface 110 to allow the test apparatus 10 to operate the headphone under test in such a way as to allow a richer set of measurements than is possible under conventional 'manual' testing. However, the benefits of such an aspiration only accrue when the headphone under test has been provided with its own reciprocal interface, capable—in whole or in part—of connecting with the new HATS' test interface and accepting its commands.

This usually pre-supposes a degree of collaboration or standardisation between the headphone manufacturer and the provider of the test equipment.

The earphone test interface, 110, is capable of (at least) powering on and off an active noise reducing headphone. The earphone test interface, 110, should additionally be capable of providing digital logic signals, which are capable of being adapted—on a case-by-case basis (or, preferentially, according to pre-determined standard)—to enable or disable i) audio playback ii) active noise reduction iii) audio EQ, iv) feed-forward noise reduction (where appropriate) and v) "binaural monitoring" or "talktrough". In those headphones under test incorporating their own microcontroller, the test interface can also signal the headphone's microcontroller to enter a dedicated 'test mode', which sets up the signal paths inside the headphone in an appropriate configuration for the relevant test.

Additionally, such a headphone with internal intelligence could also include a parameterisable noise generator, suitable for generation of its own test sequences. This could be configured by and triggered by signals from the earphone test interface.

The earphone test interface, 110, will additionally be capable of providing adjustment means by which controllable parameters of the headphone under test may be adjusted during the course of measurement, in pursuit of 'tuning' or 'trimming'. Such means may be realised through access to digital parameters stored within the headphone under test, thereby implying a digital communication link to the headphone under test. Such a link may be achieved through I2C or any appropriate technology, all of which are well rehearsed.

The same digital link (or an augmented version thereof) may be used in cases where the end result of measurement and tuning of the headphone under test requires that the findings of such measurements should be programmed into the target device as calibration or configuration constants. Such programming tasks can be achieved through One-Time Programmable ('OTP'), FLASH, E(E)PROM or other non-volatile storage technologies inside the headphone under test, which the new HATS system can be adapted to program, after its measurements are finished, using well-known methods.

In certain circumstances it is beneficial to be able to store test result meta-data within the headphone itself, and to be able to uniquely identify the headphone from a unique identifier stored with the headphone. The same digital link as above provides a vehicle for this capability.

The physical organisation of earphone test interface, 110, between the Integrated Electronics and the headphone under test presents a useful opportunity to connect to some of the signals within the headphone under test, if electrical access can be arranged (this requires collaboration on the part of the headphone developer). A communications interface on the headphone, offering all those signals required for the test interface and some data to pass into the Integrated Electronics' signal interface, 104, will add very considerably to the utility of the invention here described. Access to the voltage signal coming from the headphone under test's own internal microphone will add very considerably to the quality of observation of the internal 'feedback loop' in the case of a headphone under test operating active noise control using the 'feedback' control paradigm. Access to the voltage signal coming from the headphone under test's own external microphone will add very considerably to the quality of observation of the transmission path over the headphone shell in the case of a headphone under test either operating active noise control using the 'feedforward' control paradigm or seeking to deploy 'talk-though' features. Both methods are discussed in more detail below. The test connector may also provide a direct signal feed for the acoustic source in the headphone under test—which is useful if it is inconvenient to supply such a feed by other means (e.g. in the case of a wireless headphone).

A test connector, 116 (discussed in more detail below) including ground, (optional power), logical control signals, a digital interface for control and programming and several signal connections provides the physical link between the headphone under test and the Integrated Electronics—both for the 'earphone test interface' and (some of) the 'signal interface'. This test connector is defined at the electrical layer, but is subject to a number of embodiments (including some example preferred embodiments) at the physical/mechanical layer, to allow for a degree of flexibility in accommodating within the various form factors of different headphone industrial designs.

The Local Machine

The new measurement system is designed to be operated by a user, who interfaces to the system via a local machine, 120. That machine connects to the measurement system's 'Integrated Electronics', 100 through the 'control interface', 106. The local machine may be a standard computer, running programs developed in conventional programming languages.

In Research and Development Applications, the local machine may run explicit applications directly accessing the new measurement system's resources and making them available to the user as a primary development tool. It may also run code which acts as an intermediary between the new measurement system's resources and other computer-aided design resources running on the local machine, making the new measurement system part of the suite of development resources available during the headphone development cycle.

The applications developed for use in the R&D phase display a high degree of commonality of features, notation and 'look-and-feel' with subsequent software tools developed for use in the production phase, to encourage a sense of coherence and familiarity and to encourage the development of features important to subsequent deployment of similar measurement and manufacturing methodologies later in the production cycle (such as the provision of a 'test connector', the specification of appropriate mounting accessories for the headphone on the artificial ear and the evolution of the test script).

The harsh operational environment encountered in a factory and the limited requirement for user interaction dictate the use of an industrial computer as the local machine in the manufacturing context. The local machine in this context may have no user controls, presenting a sparse touch-screen interface and hardware to scan optical ('QR') codes, or equivalent technologies, which may identify individual headphones before tests begin. The local machine may also host a label printer, which can produce self-adhesive to identify units that fail tests and furnish limited diagnostic information on the label regarding the nature of the failure. Further information on the details of the failure is stored and can be retrieved at a later time, indexed to the headphone's identification.

The local machine may also support an interface to a wider network, through the Internet, by which the activities of all instances of the new HATS measurement system are continuously monitored on a global basis. This allows the progress of manufacture to be collected and monitored and the statistics computed and analysed. Emerging issues can be traced back to root cause (of failure mode)—potentially before yield rates dip to unacceptably low levels.

This networking of the local machine allows the tests to be observed, controlled and updated from a globally central, but transparent location, ensuring the integrity and security of the process.

Figure 15:
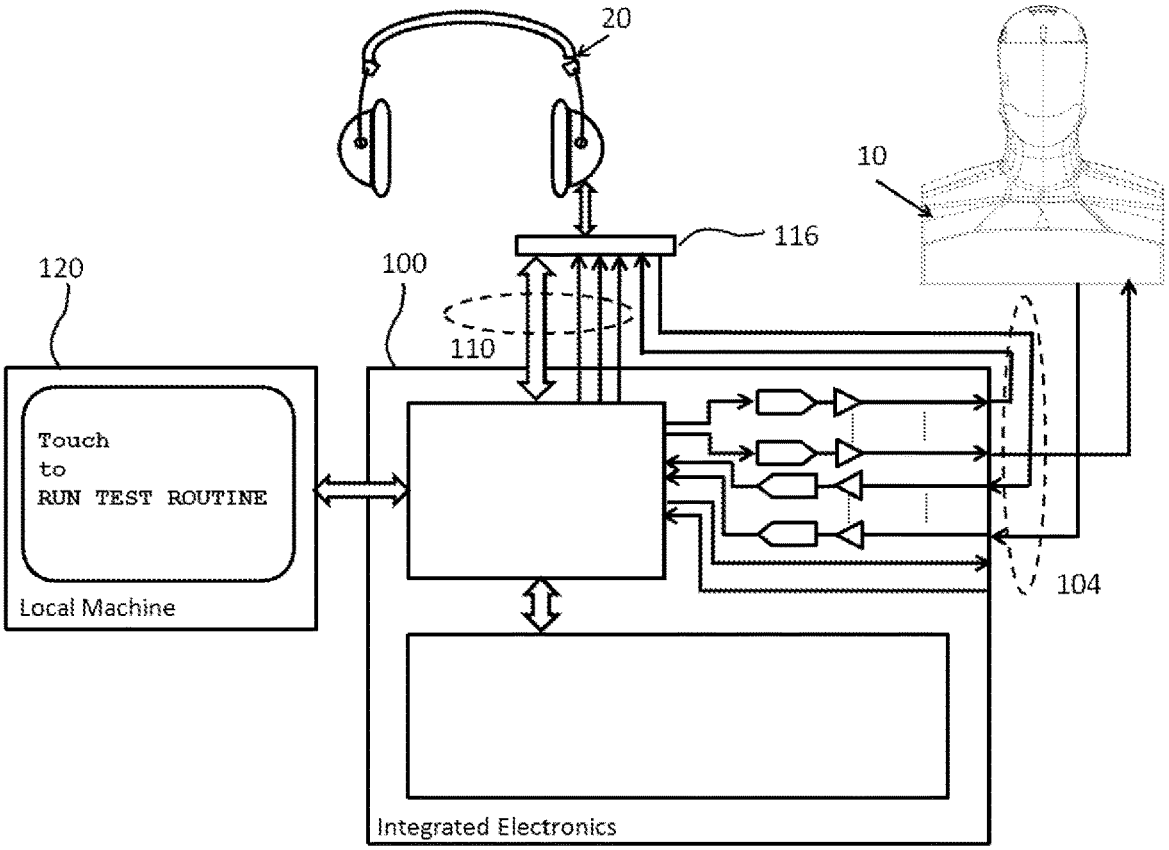
FIG. 15 is a schematic illustration of the test apparatus of FIG. 1 in an assembly line factory testing environment.

Connection of the system, further illustrating the function of the three interfaces of the Integrated Electronics, 100, detailed above, is illustrated in FIG. 15. FIG. 15 details the function of the test connector, 116, which serves to mechanically integrate some of the electrical connections of the earphone test interface, 110, and of the signal interface, 104, in their connection to the headphone under test. This integration is largely a matter of operational convenience, bundling together disparate electrical nodes into a single multi-pole connector for greater convenience of operation, particularly in the context of manufacture.

Although FIG. 15 is shown with analogue elements of the signal interface passing through the test connector', 116, it is appreciated that there may be situations where a headphone under test implemented using digital signal processing methods makes it more appropriate for the digital channels, provided in the signal interface, 104, to communicate through the test connector, 116, to said headphone. Further, in such cases, a degree of overlap in the implementation of the 'signal interface', 104, and the 'test interface', 110, of the Integrated Electronics may be observed which is interpreted in some cases as hardware redundancy; the provision of two digital interfaces—one for (aspects of) the test interface and one for (aspects of) the signal interface may be considered unnecessary. In such a case, one physical digital interface may share both functional roles. In other cases the preservation of both interfaces may offer operational benefits.

Using the New HATS System

Examples will now be presented of use of the new measurement system. The examples will illustrate use in the manufacturing test environment. It will be assumed that the headphone system under test has been developed in a context including access to the new measurement system.

In this preferred case the headphone system will incorporate features allowing easy integration with the new HATS system—most importantly the test connector, which will facilitate convenient connection between the test system and the system under test. At once, certain bespoke fixtures may have been developed to customise the measurement system for use with the headphone under test, such as custom ear plates, mounting or clamping fixtures.

Additionally, custom measurement routines will have been developed for the headphone-under-test, focussing on those features particular to that design. Tests may be run in one of two ways. First, in which the test itself is entirely expressed by a high-level, Turing Complete, programming language incorporating language elements and features for command and control of the physical components presented herein and that is parsed, interpreted, and executed by the local machine with each test execution. Second, in which a test procedure, generalised over the expected population of headphones under test, is predetermined and embodied within the software running on the local computer but customised for each application by a limited, finite set of configuration parameters covering the space required to realise an effective test regime.

In other, non-preferred applications of the new measurement system, where it is working with a headphone-under-test which cannot be so closely integrated with the functionality provided by the system taught in this description, only a sub-set of the functionality and benefits provided by the new system may be accessible to the user.

Core operation of the new measurement system involves the application of broadband, random test excitation patterns and the synchronous recording of responses in bursts of order 1 to 10 seconds duration. These data are subject to frequency-domain analysis, computed in the local machine, using conventional Fourier methods, to produce estimates of the transfer functions between excitation and response.

The system uses three types of fundamental operation upon these derived transfer functions ('TFs').

1) Does the (complex) TF fit between pre-determined bounds?

2) Does the ratio of two (or more) TFs fit between pre-determined bounds?

3) Does the magnitude of the TF fit between pre-determined bounds if subjected to a linear gain adjustment, x?

In all cases, the tests can be applied at a single-frequency, in n-th octave bands (where n is a specified integer) or at full resolution.

The full suite of measurement tests currently implemented in the new measurement system is now provided as an illustrative but not exhaustive list of possible applications of the new measurement system in the manufacturing test environment.

1) Device Identification

The measurement process is initiated by optionally either scanning the QR label on the headphone-under-test or reading a unique identifier from the headphone under test, which produces a prompt on the user touch screen inviting the operator to start the test.

2) Receiving Response

The 'Receiving Response' of the headphone is measured—this is the ratio of pressure at the (artificial) ear to the voltage applied to the headphone's receiver. It implies either i) direct access to the headphone's receiver terminals—which is impractical—or ii) knowledge of the design and configuration of the headphone and the ability to configure the headphone in such a state that a known audio input will produce a known voltage level at said receiver terminals.

Figure 16:
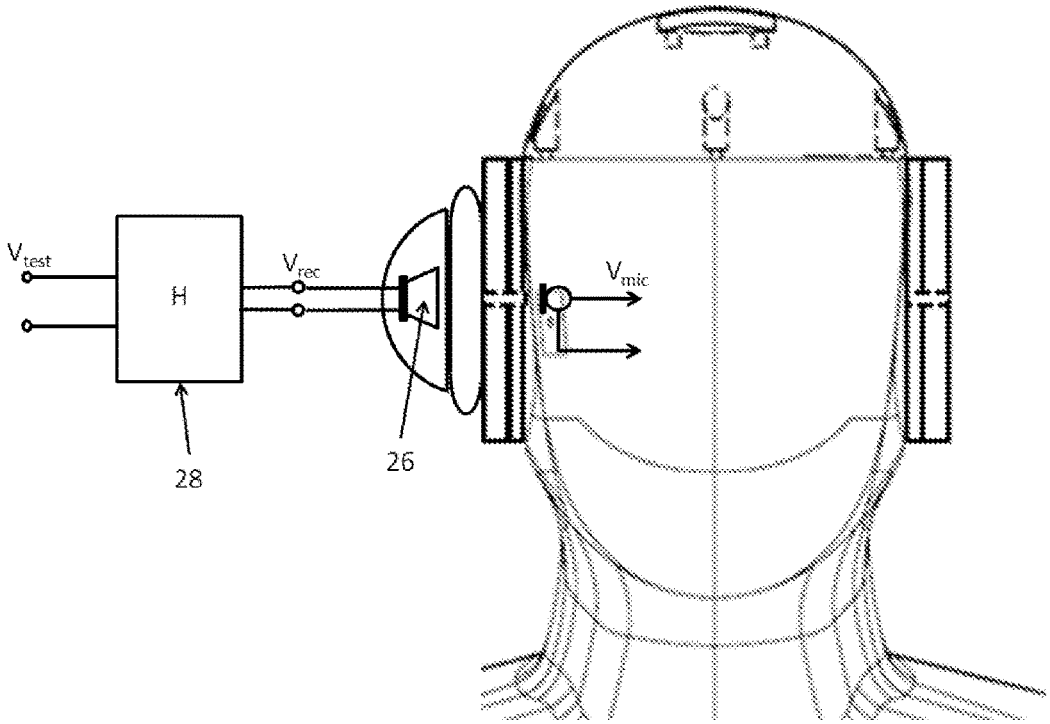
FIG. 16 is a schematic illustration of an earphone testing technique using the test apparatus of FIG. 1.

Further detail is presented in FIG. 16, which describes the situation where the operator seeks to measure the Receiving Response (which is the ratio of ear pressure to receiver voltage) and thereby characterise the electro-acoustic response of the headphone driver, 26, in situ. Ear pressure is available to the operator through linear operations on the observable microphone voltage, 46, (through the known microphone sensitivity, which will have been measured as a component of system calibration). However, the receiver terminals will frequently be unavailable to the operator—even in a headphone system which has been intentionally engineered for development and production with this test system in mind. Accordingly, an alternative approach is used, in which a (known) excitation voltage, $V_{test}$, is applied to an available system input and the transfer function, H, to the receiver terminals, 28, is known (by knowledge of the internal, detail design of the system). This allows the operator to infer the voltage at the receiver, $V_{rec}$, and measure the receiving response.

The receiving response is checked against pre-specified bounds in a go-no-go test. Note that such a strategy may impossible in those headphones that have not been appropriately engineered in their development to support such measurement during manufacture (such as noise cancelling headphones with no capability to turn off the noise cancelling and no passive bypass function).

3) Receiver Polarity

The Receiver Polarity is confirmed by an additional check of the receiving response's phase component.

4) Plant Polarity

The 'Plant Response' of the headphone under test is now considered (the ratio of pressure at the internal (feedback) microphone to the voltage applied to the headphone's receiver). The data for this measurement is actually collected concurrently with the data for the measurements above in the multi-channel data acquisition.

5) Plant Phase

First, the phase of the Plant Response is compared against pre-specified bounds in a go-no-go test.

6) Plant Fitting—for ANR Gain

Second, the combination of the measured magnitude Plant Response at one critical frequency, knowledge of the response of the control electronics inside the headphone at this frequency and the target active noise reduction at this frequency are used to compute the required setting of the loop gain for the particular headphone under test. This is performed separately for left and right channel of the headphone under test.

The receiver (i.e. the miniature loudspeaker) and the internal feedback microphone inside the headphone under test both are subject to manufacturing variations, which make their sensitivities vary slightly from sample to sample. Additionally, the assembly process of the headphone can introduce some (small) variations in acoustic performance, which introduce a further uncertainty. Both these uncertainties introduce a small sample-to-sample variation on the degree of active noise control that will be exhibited by noise cancelling headphones in manufacture. The performance of the electronic factor of the control loop is—by comparison—subject to smaller variation and the critical frequency at which this test is performed is chosen to emphasise the acoustic and electro-acoustic variability and to minimise any sensitivity to electronic variability.

7) Gain Adjust Limit

After the optimal loop gain is identified (in step 6 above) the proposed gain is tested against allowed limits to test for a viable solution—extreme gain adjustments would indicate a damaged headphone. There may also be requested gain adjustments outside the range that can be accommodated on the headphone's electronics; this test traps such violations.

8) Feedback ANR

A test of feedback active noise reduction is made with no external acoustic stimulus. This method relies solely on a measure of the receiving response (see 1, above) and a repeat measurement with the ANR circuit enabled. The difference between the two measurements will reveal (through the ANR action on the audio signal being reproduced inside the headphone) the degree of active noise reduction achieved.

9) EQ Response

Correct operation of the EQ filters in the audio path is confirmed by comparison of a measure of the receiving response (see 1, above) and a repeat measurement with the EQ filter enabled. The difference between the two measurements will reveal the frequency response of the EQ filter, which can be compared to the design target.

10) Balance Test (ANR Off)

A calculation of Left/Right audio balance is made with feedback ANR Off and the degree of L/R imbalance compared to prescribed limits, using already recorded Receiving Responses (step 2).

11) Balance Test (ANR On)

A calculation of Left/Right audio balance is made with feedback ANR On and the degree of L/R imbalance compared to prescribed limits. This calculation is made using existing measurements of Receiving Response (step 2), ANR (step 8) and EQ (step 9), rather than acquiring any new data, to save time.

The following tests are relevant only to those devices with outward-facing microphones for forward-path applications, including feed-forward control and 'Binaural Monitoring'/'Talk-through'.

12) Binaural Monitor Operation

The Transfer Function from HATS cheek microphone, 80, to ear microphone, 46, is measured—under external noise excitation from loudspeakers 84, with Binaural Monitoring first disabled and then enabled. The ratio of the two (magnitude) transfer functions is considered with reference to prescribed bounds.

13) Binaural Sealing

The Binaural Monitoring path is enabled, but with an abnormally high gain setting, and the receiving response (see 1 above) is re-measured. Any leakage path from receiver to the feed-forward microphone will be revealed as a disturbance of the measured Receiving Response. It is diagnostic of poor or incomplete sealing in assembly and could be the cause of howling/instability or a disturbance in the binaural monitor path's frequency response in use.

14) Feed-Forward Sensitivity Check

Confirm operation of the headphone under test's external ('FF') microphone by comparison with a pre-specified level (or measured cheek mic level).

15) Feed-Forward Plant Response

Measure the TF between the headphone under test's external ('FF') microphone and the HATS' internal ear microphone, 46.

16) Feed-Forward ANR Set-Up

Use Receiving Response (see 1 above) and Feed-forward Plant Response (see 15 above) to produce a model of Feed-forward ANR in order to identify optimal Feed-forward gain. Then set gain to suggested value and measure performance, using two estimates of the TF between outputs of HATS cheek microphone, 80, and HATS ear microphone, 46, in Feed-forward ANR On and Off conditions. Iterate to identify best practical ANR gain.

17) Feed-Forward Gain Adjust Limit

After the optimal loop gain is identified (in step 16 above) the proposed gain adjustment from the designed default gain is tested against allowed limits to test for a viable solution—extreme gain adjustments would indicate a damaged headphone.

The following final steps are associated with device programming:

18) Check for Device Clear

19) OTP

20) Program EPROM

21) Optional storing of test meta data in a test history memory within the headphone.

Failure of any of the tests above is reported locally to the system operator via the local machine and logged with the headphone under test's identifying data. The system is capable of performing limited diagnostic work, according to conditional rules pre-defined for each headphone type. The suggested diagnosis is available to the manufacturer in textual form, for assistance in re-work operations. Test data automatically is uploaded to remote machines for meta-analysis.

Machine-learning methods, including Neural Networks, are being deployed to develop fault recognition tools and fault prediction tools, using the test data. This modelling work is conducted at global level, where access to the meta-level statistical data from a range of different customers' products and unconstrained computational resources is required. Once tuned, the fault prediction and susceptibility tools are down-loaded to the local machine to be run during production, updated only infrequently.

The tests above are performed with a considerable degree of parallelism in data acquisition, which is summarised as follows:

Data Acquisition Steps

The excitation signal is applied in 7 discrete bursts. The test activity associated with each burst is tabulated below.

| Burst # | Tests |
|---|---|
| 1 | 2, 3, 4, 5, 6, 7, 10, (11) |
| 2 | 8, (11) |
| 3 | 9, (11) |
| 4 | 14, 15 |
| 5 | 16, 17 |
| 6 | 12 |
| 7 | 13 |

The detail configuration associated with each excitation burst is described below.

Burst 1

FB- and FF-ANR turned off and EQ path bypassed. Signal applied to Headphone-under-Test's (HUT's) audio inputs. Loopbacks (i.e. the excitation signals applied to the HUT), ear mics (46) and FB mics are recorded to get TFs of receiving responses and plant responses (2 channels for each).

This is used immediately for tests 2, 3, 4, 5, 6, 7 and 10.

Burst 2

FB-ANR turned on. Signal applied to HUT's audio inputs. Loopbacks and ear mics (46) are recorded to get TFs of receiving responses in the ANR-On condition.

These new TFs are divided by the receiving responses from Burst 1 to get the ANRs (Test 8).

Burst 3

ANR turned off and EQ path enabled. Signal applied to HUT's audio inputs. Loopbacks and ear mics (46) are recorded to get TFs of receiving responses in the EQ-On condition.

These new TFs are divided by the receiving responses from Burst 1 to get the EQs (Test 9).

Receiving responses from Bursts 1, 2 and 3 are used to obtain the ANC-On receiving responses (ANR*EQ*RecResp). These are compared for test 11.

Burst 4

Audio path disabled. FB-ANR disabled, FF-ANR disabled. Signal applied to external loudspeakers (84). HUT's FF mics (80) and HATS' ear mics (46) are recorded to get the FF plant TFs (Ear/FF mic).

The FF plant is used for tests 14 and 15

Burst 5

FF-ANR enabled and initial guess of gain adjustment applied. Signal applied to external loudspeakers (84). HATS' cheek mics (80) and ear mics (46) are recorded to get the "FF-ANR"

This is used for 16. Additional bursts may be required here for iteration in 16.

The final FF gain adjustment after the iteration is used for 17.

Burst 6

BM is turned on with gain set to default value. Signal applied to external loudspeakers (84). HATS' ear mics (46) and cheek mics (80) are recorded and TFs calculated.

A "Reference gain" is calculated for each channel using an octave band centred on a particular frequency, and the ratio of the values for the 2 channels is calculated. If one channel has higher reference gain, an adjustment is applied to that channel so that the two channels' gains are the same.

The TF for the channel that needed the adjustment (if any) is then scaled by multiplying it by that adjustment.

The (possibly scaled) TFs are compared to some bounds.

Burst 7

BM is turned on with high gain. Signal applied to HUT's audio inputs. Loopbacks and ear mics (46) are recorded to get receiving responses in BM-on state.

These new TFs are divided by the receiving responses from Burst 1 to be used in Test 13.

The invention claimed is:

1. Apparatus for testing earphone apparatus during manufacture, comprising:

a head simulator including an ear simulator defining a passageway leading to an external opening; and an eardrum microphone mounted in the passageway of the ear simulator part;

wherein the apparatus comprises:

an ear plate for simulating an outer ear, the ear plate forming part of the ear simulator and defining a substantially planar earphone engagement surface substantially encircling the external opening;

a mounting guide system for assisting correct placement of earphone apparatus on the head simulator relative to the ear simulator; and/or a test module for performing rapid automated testing of earphone apparatus mounted on the head simulator, wherein the head simulator further comprises at least one cheek-mounted microphone for sensing externally generated sound.

2. Apparatus according to claim 1, wherein the head simulator is a head and torso simulator (HATS) device.

3. Apparatus according to claim 2, wherein the HATS device comprises a torso portion housing the test module.

4. Apparatus according to claim 1, wherein the ear plate comprises a part that is detachable from the head simulator.

5. Apparatus according to claim 4, wherein the ear plate comprises a base portion connected to the head simulator and a detachable outer part defining the substantially planar earphone engagement surface.

6. Apparatus according to claim 1, wherein the mounting guide system comprises a headband positioning guide operative to assist positioning of a headband in a predetermined orientation relative to the head simulator.

7. Apparatus according to claim 1, wherein the mounting guide system comprises an earphone unit positioning guide.

8. Apparatus according to claim 7, wherein the earphone unit position guide is configured to hold the earphone unit in the predetermined position.

9. Apparatus according to claim 8, wherein the earphone unit positioning guide comprises one or more locating pins.

10. Apparatus according to claim 8, wherein the earphone unit positioning guide comprises one or more locating walls.

11. Apparatus according to claim 1, wherein the mounting guide system comprises a sealing part for applying an enhanced sealing force to an earphone unit.

12. Apparatus according to claim 11, wherein the sealing part comprises an ear plate having a profile operative to cause a headband of the earphone apparatus under test to stretch beyond its normal range to generate an additional sealing force.

13. Apparatus according to claim 12, wherein the substantially planar earphone engagement surface is angled to minimise angular displacement between the headband and earphone unit.

14. Apparatus according to claim 13, wherein the passageway extends normal to the angled face of the substantially planar earphone engagement surface.

15. Apparatus according to claim 11, wherein the sealing part comprises clamping part.

16. Apparatus according to claim 15, wherein the clamping part comprises a movable clamping member.

17. Apparatus according to claim 15, wherein the clamping part comprises a static clamping member.

18. Apparatus according to claim 1, wherein the eardrum microphone is mounted at an opposed end of the passageway to the external opening.

19. Apparatus according to claim 1, wherein the head simulator further comprises an internal driver operative to generate a test signal.

20. Apparatus according to claim 19, wherein the internal driver is mounted at an opposed end of the passageway to the external opening.

21. Apparatus according to claim 20, wherein the internal driver is provided as part of a unit including the eardrum microphone.

22. Apparatus according to claim 1, wherein the apparatus further comprises a mounting frame for at least one external loudspeaker.

23. Apparatus according to claim 1, wherein the test module comprises a signal interface operative to transmit audio signals to at least one driver and receive measurement signals from at least one microphone.

24. Apparatus according to claim 23, wherein the test module is configured to provide a multi-channel output and receive a multi-channel set of responses.

25. Apparatus according to claim 23, wherein the test module is configured to store one or more pre-generated test patterns.

26. Apparatus according to claim 23, wherein the test module is configured to store received measurement signals.

27. Apparatus according to claim 23, wherein the test module further comprises a control interface for connecting the test module to a control device.

28. Apparatus according to claim 27, wherein the control device is connected to a computer network.

29. Apparatus according to claim 1, wherein the test module further comprises an earphone test interface for communicating with the earphone apparatus.

30. Apparatus according to claim 29, wherein the earphone test interface is operative to allow the test module to perform:

power on/power off active earphone functionality;
provide digital logic signals to enable/disable:
audio playback;
active noise reduction;
audio EQ;
feed-forward noise reduction;
binaural monitoring/talk through;
instruct the earphone apparatus to enter a test mode;
instruct adjustment of controllable parameters; and/or
transmit calibration or configuration constants determined during testing to the earphone apparatus.

31. Apparatus according to claim 29, wherein the earphone test interface provides signals to the signal interface.

32. Apparatus according to claim 1, wherein the at least one cheek-mounted microphone comprises a sensor surface or a sensor inlet provided substantially in line with an outer surface of a cheek portion of the head simulator.

33. An automated method of testing earphone apparatus during a production line manufacturing process comprising:

providing test apparatus as defined in claim 1;
positioning earphone apparatus to be tested in a predetermined test position relative to the ear simulator of the head simulator of the test apparatus; and
running a program to perform to perform the steps of:
a test phase comprising:
activating a pre-generated test pattern; and
collecting at least one response; and
an analysing step comprising analysing the at least one response.

34. A method according to claim 33, wherein the at least one response collected during the test phase is used to perform a first analysis stage.

35. A method according to claim 33, wherein the analysing step comprises:

determining whether a determined property of the earphone apparatus falls within an acceptable range;
determining a value for calibrating or adjusting a programmable earphone apparatus;
performing diagnostic analysis; and/or
collecting response data.

36. A method according to claim 33, wherein the method further comprises performing at least one further test phase comprising a further activating step and a further collecting step.

37. A method according to claim 36, wherein the at least one further test phase occurs after the first-defined test phase is completed.

38. A method according to claim 36, wherein the at least one response collected during the at least one further test phase is used to perform a second analysis stage.

39. A method according to claim 38, wherein the second analysis stage uses data from the at least one response collected during the first-defined test phase and/or results from the first analysis stage.

40. A method according to claim 36, wherein the first analysis stage is conducted before the at least one further test phase is initiated.

41. A method according to claim 33, wherein in the case of programmable earphone apparatus the method may further comprise programming the earphone apparatus as a result of the analysing step.

42. A method according to claim 33, wherein the analysing step comprises:

a receiving response check;
a receiver polarity check;
a plant response check;
a plant phase check;
a plant fitting check;
a gain adjust limit check;
a feedback ANR check;
an EQ response check; and/or
a balance test.

43. A method according to claim 42, wherein the receiving response check comprises:

a test phase comprising:
selecting a pre-generated internal test pattern;
activating the pre-generated internal test pattern using the driver of the earphone apparatus to be tested; and
measuring the response of the eardrum microphone; and
an analysis step comprises calculating the ratio of pressure at the eardrum microphone to voltage applied to the driver of the earphone apparatus based on the measured response and a determined voltage at the driver of the earphone apparatus being tested, and comparing the ratio with a predetermined reference value.

44. A method according to claim 43, wherein the feedback ANR check comprises:

repeating the test phase and analysis step of the receiving response check with feedback ANR functionality enabled; and
in a further analysis step determining the level of ANR feedback by comparing the difference between the two calculated receiving responses and comparing the determined level of ANR feedback with a predetermined design target.

45. A method according to claim 43, wherein the EQ response test comprises;

repeating the test phase and analysis step of the receiving response check with an EQ filter enabled; and
in a further analysis step determining a frequency response of the EQ filter by comparing the difference between the two calculated receiving responses and comparing the determined frequency response with a predetermined design target.

46. A method according to claim 43, wherein the balance test comprises an analysis step comprising:

calculating left/right audio balance with feedback ANR functionality disabled using the receiver response calculated via the test phase and the analysis step of the receiving response check for the left and right channels; and comparing the calculated left/right audio balance with a predetermined reference value.

47. A method according to claim 43, wherein the balance test comprises an analysis step comprising:

calculating left/right audio balance with feedback ANR functionality enabled using the receiver response via the test phase and the analysis step of the receiving response check;

calculating feedback ANR level by repeating the test phase and analysis step of the receiving response check with feedback ANR functionality enabled, and, in a further analysis step, determining the level of ANR feedback by comparing the difference between the two calculated receiving responses and comparing the determined level of ANR feedback with a predetermined design target;

calculating EQ response for each of the left and right channels by repeating the test phase and analysis step of the receiving response check with an EQ filter enabled, and, in a further analysis step, determining a frequency response of the EQ filter by comparing the difference between the two calculated receiving responses and comparing the determined frequency response with a predetermined design target; and comparing the calculated left/right audio balance with a predetermined reference value.

48. A method according to claim 42, wherein the voltage at the driver of the earphone apparatus is determined by with reference to an excitation voltage known to be input to the earphone apparatus by the pre-generated internal test pattern and a known transfer function from the input to the driver terminals.

49. A method according to claim 42, wherein the receiver polarity check comprises an analysis step comprising checking a phase component of the measured receiving response for correct polarity.

50. A method according to claim 42, wherein the plant response check comprises:

a test phase comprising:

measuring the response of the feedback microphone of the earphone apparatus being tested to the pre-generated internal test pattern when supplied using the driver of the earphone apparatus to be tested; and an analysis step may comprising calculating a ratio of detected pressure at the feedback microphone to voltage applied to the earphone driver.

51. A method according to claim 50, wherein the plant phase check comprises: a further analysis step after determining the plant response, the further analysis step comprising determining a plant phase associated with the plant response and comparing the identified plant phase with a predetermined reference value.

52. A method according to claim 50, wherein the plant fitting check comprises: a further analysis step after determining the plant response, the further analysis step comprising determining the measured magnitude of the plant response at a critical frequency and computing a required setting of loop gain for the earphone apparatus under test.

53. A method according to claim 33, wherein in the case of earphone apparatus comprising a feedforward microphone the analysis step comprises:

a binaural monitor operation check;

a binaural sealing check;

a feedforward sensitivity check;

a feedforward plant response check;

a feedforward ANR set-up step; and/or a feedforward gain adjust limit check.

54. A method according to claim 53, wherein the binaural monitor operation check comprises:

a test phase comprising:

selecting a pre-generated external test pattern;

activating the pre-generated external test pattern whilst the binaural monitoring function is disabled and measuring a first transfer function from the cheek-mounted microphone to the eardrum microphone;

activating the pre-generated external test pattern whilst the binaural monitoring function is enabled and measuring a second transfer function from the cheek-mounted microphone to the eardrum microphone; and an analysis step comprising comparing the ratio of the first and second transfer functions to a predetermined reference value.

55. A method according to claim 53, wherein the binaural sealing check comprises:

performing a receiving response check, wherein the receiving response check comprises:

a test phase comprising: selecting a pre-generated internal test pattern;

activating the pre-generated internal test pattern using the driver of the earphone apparatus to be tested; and measuring the response of the eardrum microphone; and an analysis step comprises calculating the ratio of pressure at the eardrum microphone to voltage applied to the driver of the earphone apparatus based on the measured response and a determined voltage at the driver of the earphone apparatus being tested, and comparing the ratio with a predetermined reference value; and a further test phase in which binaural monitoring is enabled with a gain setting at an elevated test level and re-measuring the receiving response by performing the receiving response check; and an analysis step comprising comparing the re-measured receiving response with the originally measured receiving response.

56. A method according to claim 53, wherein the feedforward sensitivity check comprises:

a test phase comprising:

selecting a pre-generated external test pattern; activating the pre-generated external test pattern and measuring the response of the feedforward microphone of the earphone apparatus under test; and an analysis step comprising comparing the response of the feedforward microphone of the earphone apparatus to a predetermined reference value.

57. A method according to claim 56, wherein the test phase comprises measuring the response of the cheek-mounted microphone and the analysis step comprises comparing the difference between the feedforward microphone and cheek-mounted microphone responses to a predetermined reference value.

58. A method according to claim 53, wherein the feedforward plant response check comprises:

a test phase comprising:

selecting a pre-generated external test pattern;

activating the pre-generated external test pattern and measuring the responses of the feedforward microphone of the earphone apparatus under test and the eardrum microphone; and an analysis step comprising determining a transfer factor between the feedforward microphone of the earphone apparatus under test and the eardrum microphone based on the measured responses and comparing the determined transfer factor with a predetermined reference value.

59. A method according to claim 53, wherein the feedforward ANR set-up step comprises:

an analysis step comprising:

using a receiving response and a feedforward plant response to generate a model of feedforward ANR performance;

identifying from the model a suggested value of optimal feedforward gain; and programming the earphone apparatus under test with the suggested value of optimal feedforward gain;

wherein the receiving response is calculated by a test phase comprising:

selecting a pre-generated internal test pattern;

activating the pre-generated internal test pattern using the driver of the earphone apparatus to be tested; and measuring the response of the eardrum microphone; and an analysis step comprises calculating the ratio of pressure at the eardrum microphone to voltage applied to the driver of the earphone apparatus based on the measured response and a determined voltage at the driver of the earphone apparatus being tested, and comparing the ratio with a predetermined reference value, and wherein the feedforward plant response is calculated by a test phase comprising:

selecting a pre-generated external test pattern;

activating the pre-generated external test pattern and measuring the responses of the feedforward microphone of the earphone apparatus under test and the eardrum microphone; and an analysis step comprising determined a transfer factor between the feedforward microphone of the earphone apparatus under test and the eardrum microphone based on the measured responses and comparing the determined transfer factor with a predetermined reference value.

60. A method according to claim 59, wherein the feedforward ANR set-up step further comprises:

a further test phase comprising:

selecting a pre-generated external test pattern;

activating the pre-generated external test pattern whilst the feedforward ANR function is disabled and measuring a first transfer function from the cheek-mounted microphone to the eardrum microphone;

activating the pre-generated external test pattern whilst the feedforward ANR function is enabled and measuring a second transfer function from the cheek-mounted microphone to the eardrum microphone; and an analysis step comprising comparing the ratio of the first and second transfer functions to a predetermined reference value.

61. Apparatus for testing earphone apparatus during manufacture, comprising:

a head simulator including an ear simulator defining a passageway leading to an external opening; and an eardrum microphone mounted in the passageway of the ear simulator part;

wherein the apparatus comprises:

an ear plate for simulating an outer ear, the ear plate forming part of the ear simulator and defining a substantially planar earphone engagement surface substantially encircling the external opening;

a mounting guide system for assisting correct placement of earphone apparatus on the head simulator relative to the ear simulator; and/or a test module for performing rapid automated testing of earphone apparatus mounted on the head simulator;

wherein the head simulator further comprises an internal driver operative to generate a test signal.

62. Apparatus according to claim 61, wherein the internal driver is mounted at an opposed end of the passageway to the external opening.

63. Apparatus according to claim 62, wherein the internal driver is provided as part of a unit including the eardrum microphone.

64. An automated method of testing earphone apparatus during a production line manufacturing process comprising:

providing test apparatus as defined in claim 61;

positioning earphone apparatus to be tested in a predetermined test position relative to the ear simulator of the head simulator of the test apparatus; and running a program to perform to perform the steps of:

a test phase comprising:

activating a pre-generated test pattern; and collecting at least one response; and an analysing step comprising analysing the at least one response.

* * * * *